US010843859B2

(12) United States Patent
Blysniuk et al.

(10) Patent No.: US 10,843,859 B2
(45) Date of Patent: Nov. 24, 2020

(54) HERMETIC, HYGIENIC, SINGLE-USE PACKAGING FOR CONSUMABLE LIQUIDS

(71) Applicant: 2677126 Ontario Inc., Toronto (CA)

(72) Inventors: Gregory Blysniuk, Toronto (CA); Dmytro James Bojeczko, Toronto (CA)

(73) Assignee: 2677126 ONTARIO INC., Toronto (CA)

( * ) Notice: Subject to any disclaimer, the term of this patent is extended or adjusted under 35 U.S.C. 154(b) by 0 days.

(21) Appl. No.: 16/527,248

(22) Filed: Jul. 31, 2019

(65) Prior Publication Data

US 2020/0255201 A1 Aug. 13, 2020

Related U.S. Application Data

(60) Provisional application No. 62/804,586, filed on Feb. 12, 2019.

(51) Int. Cl.
*B65D 75/58* (2006.01)
*B65D 75/66* (2006.01)
(Continued)

(52) U.S. Cl.
CPC ..... *B65D 75/5811* (2013.01); *B65B 3/02* (2013.01); *B65B 3/04* (2013.01); *B65D 75/66* (2013.01); *B65D 83/0055* (2013.01)

(58) Field of Classification Search
CPC ..... B65D 75/5811; B65D 75/66; B65D 83/0055; B65B 3/02; B65B 3/04
(Continued)

(56) References Cited

U.S. PATENT DOCUMENTS 2,697,531 A * 12/1954 Hood ..... A61J 9/005 215/11.3
4,095,728 A 6/1978 Chlystun
(Continued)

FOREIGN PATENT DOCUMENTS

DE 8800056 U1 5/1988
EP 1035032 9/2000
(Continued)

OTHER PUBLICATIONS

International Search Report and Written Opinion for PCT/CA2020/050177 dated Apr. 20, 2020.

*Primary Examiner* — Jes F Pascua

(57) ABSTRACT

In one aspect, a disposable container for hygienic dispensing of a consumable liquid is disclosed. The container comprises a bag made from a flexible, liquid-impermeable material and has a flexible body portion for containing a consumable liquid and a flexible neck portion with a hermetically sealed mouth. The mouth is for dispensing the consumable liquid upon when opened. The neck portion is in a stored position, tucked inside-out inside the body portion. The tucking results in a continuous fold in the bag. The container also comprises a closure for holding together opposite sides of the bag at the continuous fold to maintain the neck portion of the bag in the stored position, tucked inside-out within the body portion, and to shield the neck portion from external contaminants pending opening or removal of the closure and eversion of the neck portion into a dispensing position.

20 Claims, 15 Drawing Sheets

(51) Int. Cl.
*B65D 83/00* (2006.01)
*B65B 3/02* (2006.01)
*B65B 3/04* (2006.01)

(58) Field of Classification Search
USPC ..... 383/36, 68, 69, 906, 205, 206
See application file for complete search history.

(56) References Cited

U.S. PATENT DOCUMENTS

| | | | | |
|---|---|---|---|---|
| 4,537,308 | A | 8/1985 | Hollander | |
| 4,640,425 | A * | 2/1987 | Cabernoch | A61J 9/005 215/11.1 |
| 5,863,131 | A | 1/1999 | Nakamura | |
| 6,435,374 | B1 | 8/2002 | Tabaroni | |
| 6,959,523 | B2 | 11/2005 | Reynolds | |
| 8,931,664 | B2 | 1/2015 | Foster | |
| 2003/0231808 | A1 * | 12/2003 | Machacek | B65D 33/2591 383/36 |
| 2004/0066983 | A1 * | 4/2004 | Hogan | B65D 31/10 383/64 |
| 2010/0038386 | A1 | 2/2010 | Pritchard | |
| 2010/0187254 | A1 | 7/2010 | Tschantz et al. | |
| 2013/0118134 | A1 * | 5/2013 | Perell | A23L 27/60 53/492 |
| 2017/0029174 | A1 | 2/2017 | Steele et al. | |
| 2019/0389641 | A1 * | 12/2019 | Herron | B65D 75/008 |

FOREIGN PATENT DOCUMENTS

| | | | |
|---|---|---|---|
| FR | 2801282 | B1 | 2/2002 |
| FR | 2801283 | B1 | 2/2002 |
| WO | 2018125215 | A1 | 7/2018 |

* cited by examiner

HERMETIC, HYGIENIC, SINGLE-USE PACKAGING FOR CONSUMABLE LIQUIDS

CROSS-REFERENCE TO RELATED APPLICATIONS

The present application claims the benefit of prior U.S. provisional application Ser. No. 62/804,586 filed Feb. 12, 2019, the contents of which are hereby incorporated by reference hereinto.

TECHNICAL FIELD

The present disclosure relates to packages for liquids, and more to hermetic, hygienic, single-use packaging for consumable liquids.

BACKGROUND

Disposable containers for consumable liquids, such as water or other beverages, come in various forms. One form of disposable container is a plastic bottle. Plastic bottles may be made from a material such as polyethylene terephthalate (PET) and typically have a generally cylindrical body with a rigid mouth and a removable screw-on cap. Another form of disposable container for single servings of consumable liquid is a "drink box" or foil pouch. These types of containers may be sold with associated straws that are used to pierce a wall of the container to access the liquid within. For sanitary reasons, the straws are typically packaged in cellophane which is removed and discarded before use. Other types of containers are known.

Consumption of liquid from portable containers may be convenient when tap water and other beverages are not readily available. For example, a person engaged in physical activity such as running, biking, or hiking in an outdoor setting may wish to carry a beverage container for drinking on the go. In another example, people at construction sites or in natural disaster areas may rely upon disposable containers of consumable liquid for hydration because other sources of consumable liquid may not be readily available.

From the perspective of environmental conservation, it is desirable for disposable containers to be made from a minimum of material so that, upon disposal of the containers, a minimum of waste is generated. It is also desirable for disposable containers to be usable in a hygienic manner in possibly unhygienic environments such as construction sites or natural disaster areas.

BRIEF DESCRIPTION OF THE DRAWINGS

In the figures which illustrate example embodiments.

DETAILED DESCRIPTION

In this document, the term "exemplary" should be understood to mean "an example of" and not necessarily to mean that the example is preferable or optimal in some way. Terms such as "width," "height", "upward," "upwardly," "downwardly," and "bottom" may be used to describe some embodiments in this description but should not be understood to necessarily connote an orientation of the embodiments during manufacture or use.

Figure 1:
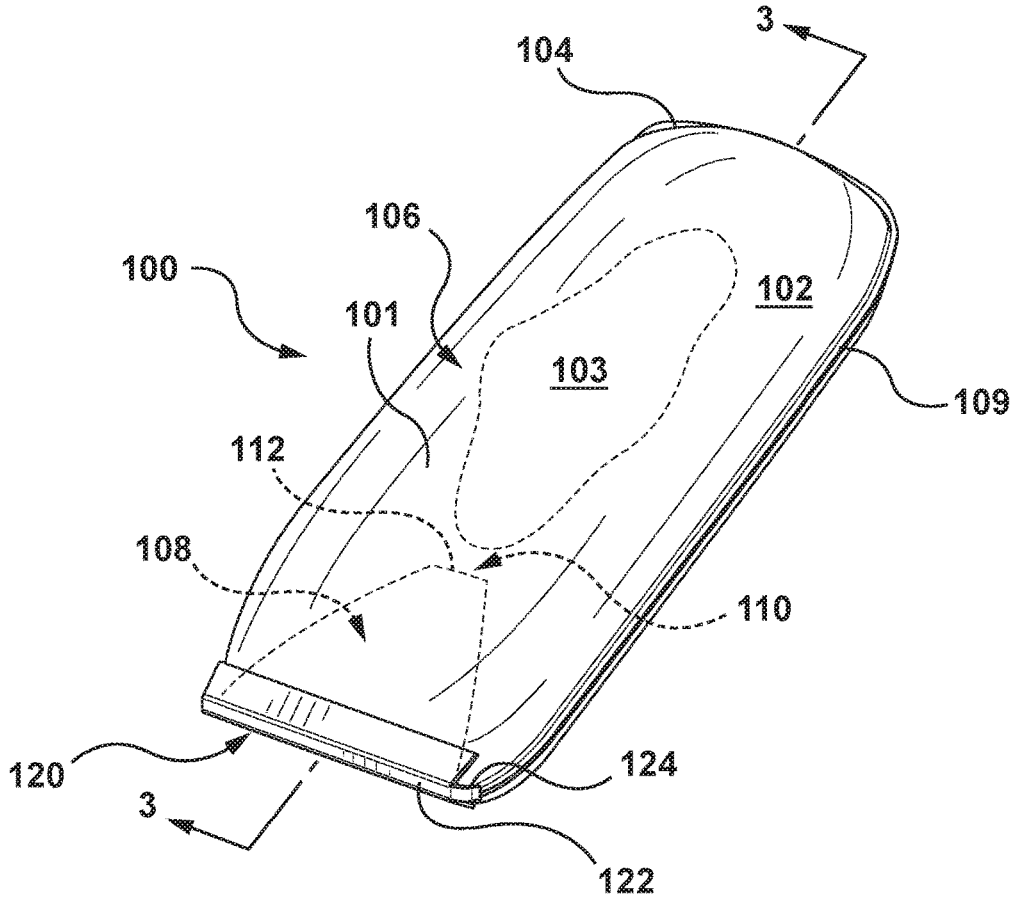
FIG. 1 is a perspective view of an example disposable container.
Figure 2:
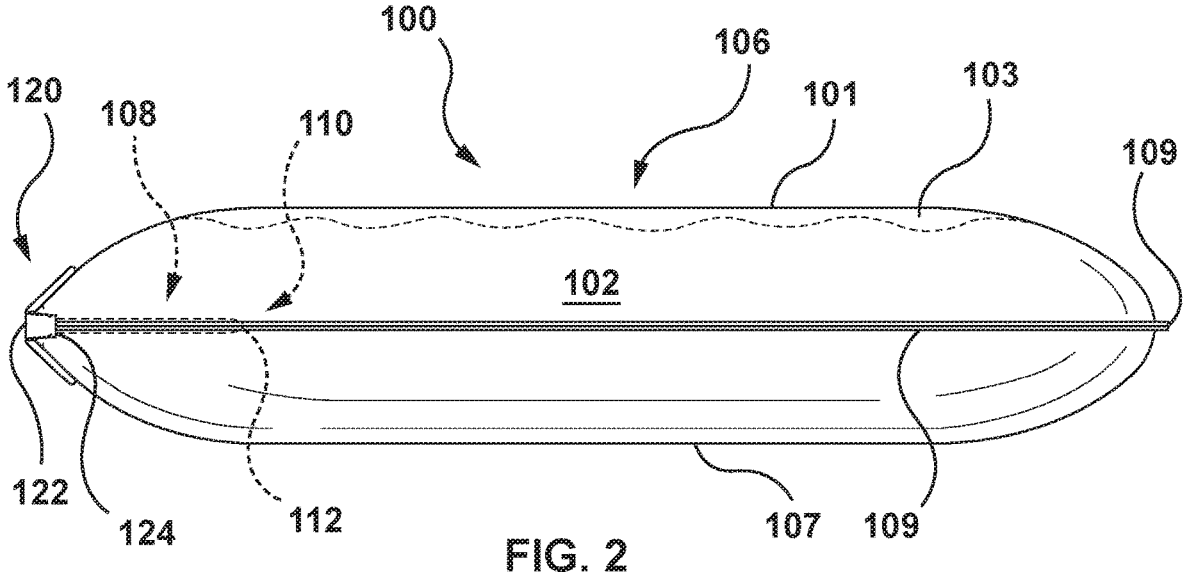
FIG. 2 is a side elevation view of the disposable container of FIG. 1.

Referring to FIGS. 1 and 2, an exemplary disposable container 100 for consumable liquids is shown in perspective view and side elevation view, respectively. The depicted container 100 may be suitable for conveniently dispensing consumable liquid 102 in a hygienic manner in environments where access to clean municipal water or other sources of hydration are limited or absent, such as construction sites, remote outdoor areas, or natural disaster areas for example, or during recreational, leisure, or sporting activities.

In FIGS. 1 and 2, the container 100 is depicted in a filled state, i.e. with a volume of consumable liquid 102 stored therein, lying on a flat surface (the latter not being expressly depicted). An air pocket 103 may be trapped inside the container above liquid 102.

Figure 5:
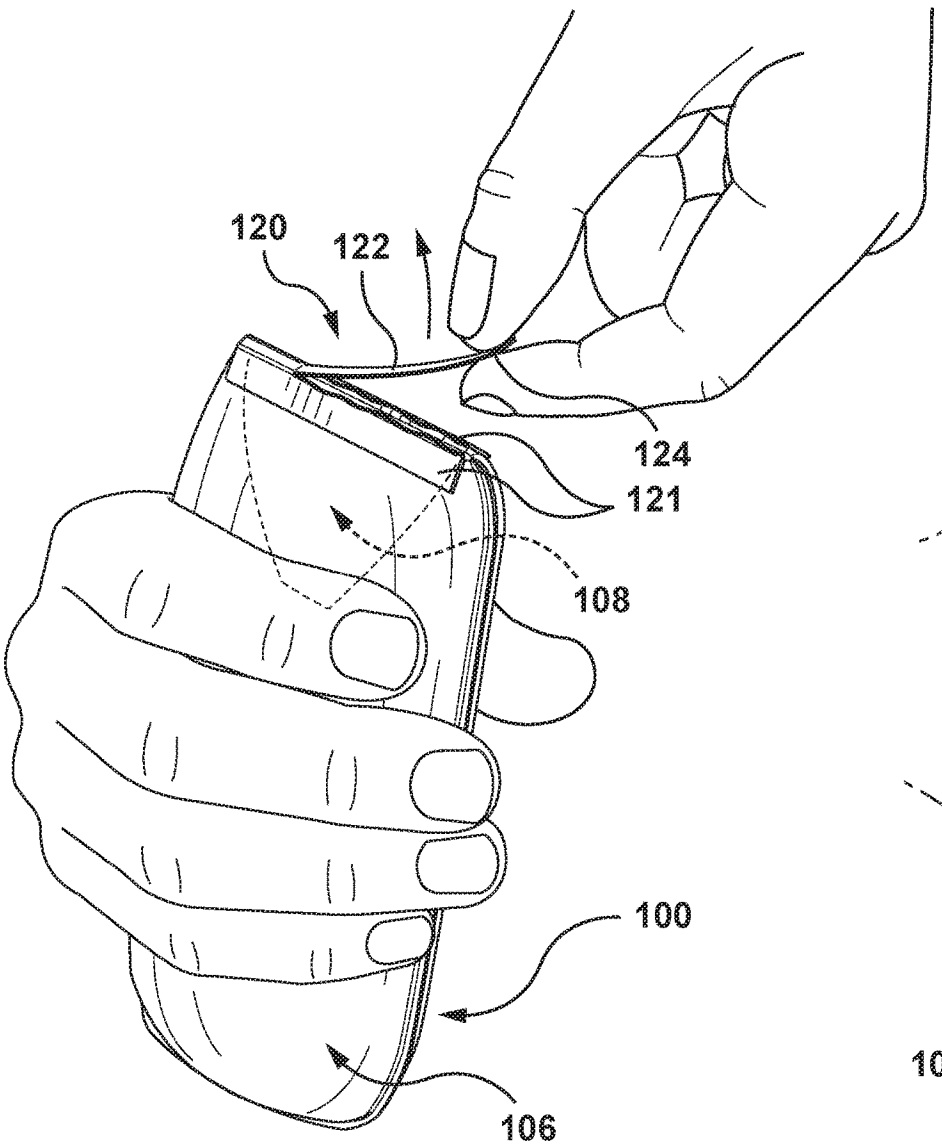

The disposable container 100 may be sized to substantially fit in the closed hand of a typical adult person, with only a minor portion of the container extending above and/or below the hand, e.g. as shown in FIG. 5 (described below). In one example embodiment, the dimensions of the container may be approximately 4.5 inches long by approximately 2 inches wide. The container may be sized to contain a volume of liquid 102 that can easily be fully consumed in one or two mouthfuls, e.g. 50 milliliters. The amount of liquid may be sufficient to at least temporarily hydrate a person, e.g. during physical activity or in an emergency situation, without being excessively burdensome to carry. The size of the container and the volume of liquid contained therein may vary between embodiments.

The disposable container 100 of FIGS. 1 and 2 may be considered to comprise a bag or pouch 101. The bag 101 is made from a flexible, liquid-impermeable material 104, e.g. a sheet of translucent plastic polymer of the type used to make zip-to-seal (e.g. Ziploc™) bags. The material 104 may for example be a low-density polyethylene (LDPE) or linear low-density polyethylene (LLDPE). Translucency is not absolutely required but may be desirable for visibility of the contained liquid 102. Other flexible, liquid impermeable materials may be used in other embodiments.

By virtue of the flexibility of material 104 and the liquid state of the contents held in the body portion 106, the filled container 100 may be deformable, e.g. when handled. For example, a wall of the filled container 100 may become slightly indented where it is being held by a user. Similarly, a downwardly facing wall 107 of the filled container 100 may become flattened when the container rests on a flat surface, e.g. as shown in FIG. 2.

As shown in FIGS. 1 and 2, the disposable container 100 has two main sections: a flexible body portion 106 for storing the consumable liquid 102 and a flexible neck portion 108 with a mouth 110 for dispensing the liquid. These two sections 106, 108 are in fluid communication with one another.

As perhaps best seen in FIG. 1, the body portion 106 of the illustrated container 100 has a substantially or generally rectangular shape, and the neck portion 108 has a substantially or generally trapezoidal shape. The body and neck portions of the container may have other shapes in other embodiments.

The neck portion 108 tapers in the direction of mouth 110, which constitutes the narrowest point of the neck portion 108. The mouth 110 is situated at the distal end of neck portion 108 and may thus be referred to as distal mouth 110. The tapering of the neck portion 108 and/or narrowness of mouth 110 may limit the cross-sectional area of the mouth 110 once opened. This may facilitate liquid dispensing, e.g. by limiting a flow rate of dispensed liquid. The limited flow rate may be one that allows a person to easily take in all of the liquid exiting mouth 110 when the container 100 is raised to the person's mouth 110 and tipped or squeezed. A limited flow rate may also help to limit any inadvertent spillage of the liquid during dispensing.

Prior to use, the mouth 110 of the neck portion 108 is closed by a hermetic seal 112. The seal 112 may intentionally be made the weakest point of container 100 to facilitate opening, as will be described.

FIGS. 1 and 2 depict neck portion 108 in a stored position. In the stored position, the neck portion 108 is tucked inside-out within, and extends inwardly into, body portion 106. As will become apparent, the rationale for storing the neck portion 108 in this way may include at least one of the following: keeping the neck portion 108 in a hygienic state prior to its eversion for liquid dispensing; reducing the space occupied by container 100 prior to liquid dispensing (e.g. during shipping); and efficiently using the same material 104 not only to define a wall of body portion 106 but also as a cover for the stored neck portion 108.

It will be appreciated that, since neck portion 108 is stored in an inside-out state, the exterior (outwardly facing) surface of the stored neck portion 108 in contact with liquid 102 will ultimately form the interior (inwardly facing) surface of the neck portion 108 upon eversion of neck portion 108 into a dispensing position. Conversely, the interior surface of the stored, inside-out neck portion 108 will ultimately form the exterior surface of the neck portion 108 in the everted dispensing position. This will become apparent when the method of opening container 100 is described below.

Referring again to FIGS. 1 and 2, it can be seen that the container 100 further comprises a closure 120. The purpose of closure 120 is twofold. Firstly, closure 120 keeps the neck portion 108 in the stored position prior to use. Secondly, closure 120 shields the neck portion 108 and mouth 110 of container 100 from external contaminants prior to use, with a view to promoting hygienic consumption of liquid 102. The closure 120 is described in more detail below.

Figure 3:
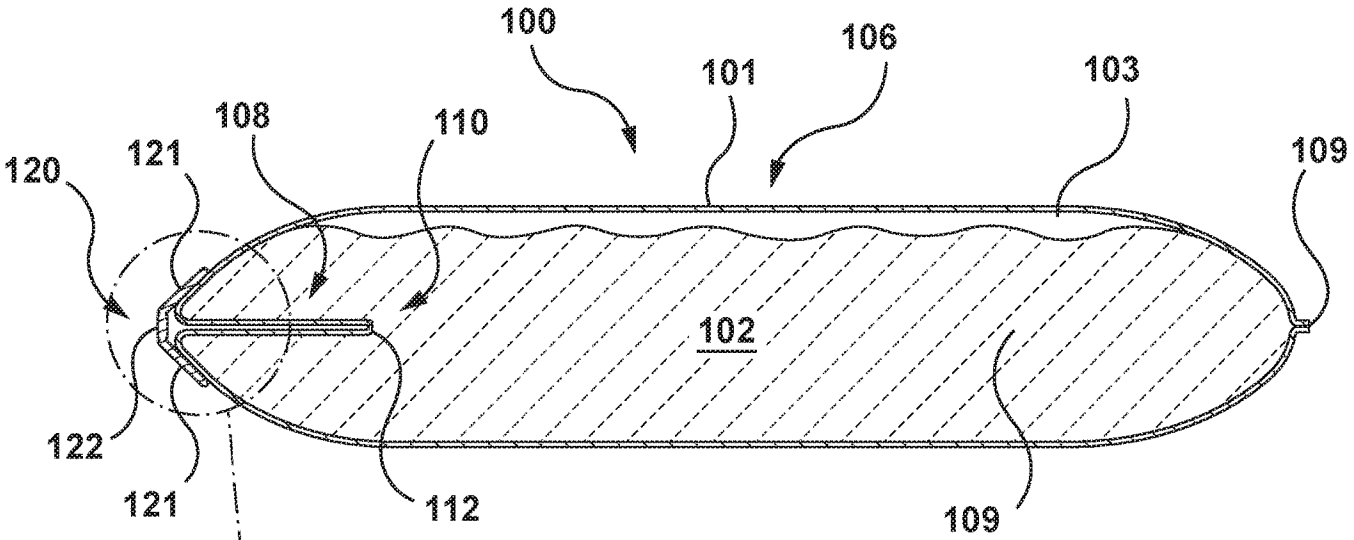
FIG. 3 is a longitudinal cross-section side view of disposable container taken along line 3-3 of FIG. 1.
Figure 4:
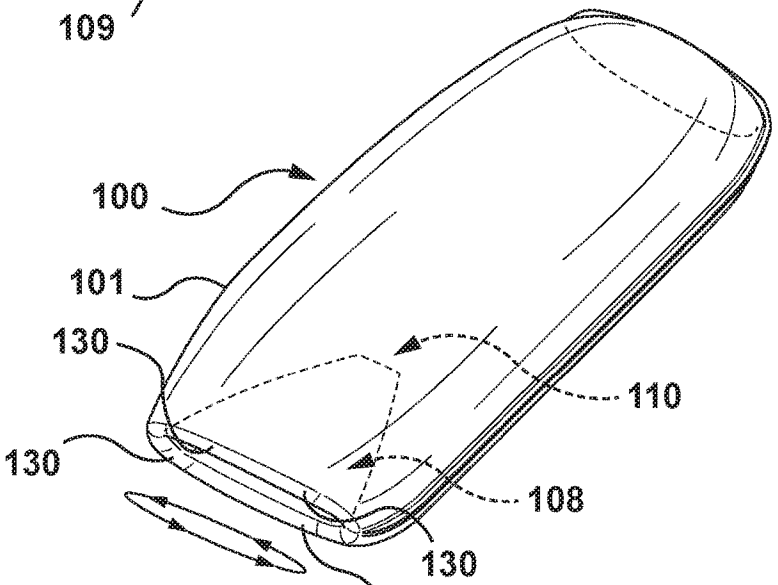
FIG. 4 is a perspective view of a portion of the container of FIG. 1.
Figure 3A:
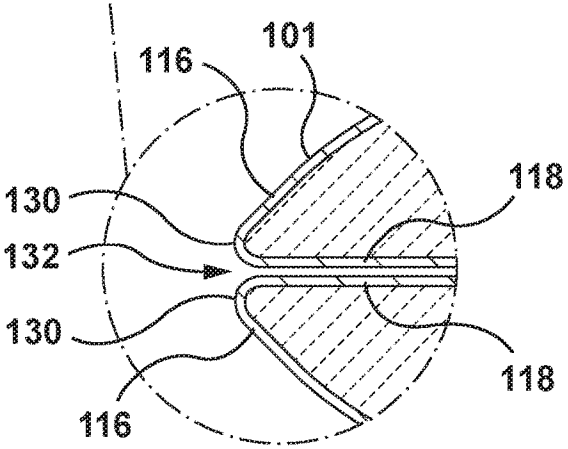
FIG. 3A is an enlargement of a portion of FIG. 3.

FIG. 3 is a longitudinal cross-section side view of disposable container 100 taken along line 3-3 of FIG. 1. FIG. 3A is an enlargement of a portion of FIG. 3 in which the closure 120 is omitted for clarity. FIG. 4 is a perspective view of a portion of the container 100, also with the closure 120 omitted for clarity.

As best seen in FIGS. 3A and 4, the tucking or storing of neck portion 108 inside-out within the interior of body portion 106 results in a continuous fold 130 in the bag 101. For clarity, the term "continuous fold" as used herein refers to a fold that is endless or forms a loop, e.g. as denoted by the continuous arrow in FIG. 4. The formation of continuous fold 130 during manufacture of one example embodiment is described below.

Referring to FIGS. 1-3, it can be seen that the closure 120 keeps neck portion 108 in the stored position, tucked inside-out within the body portion 106, by holding together opposite sides of the flexible material 104 forming bag 101 at the continuous fold 130. Moreover, it can be seen that closure 120 promotes hygiene by shielding the neck portion 108 and mouth 110 of container 100 from external contaminants, i.e. keeps contaminants from entering the area 132 between opposing walls 118 (FIG. 3A) of the stored neck portion 108. As such, the surface of walls 118 that will become the exterior surface of neck portion 108 upon its eversion are kept clean.

As illustrated in FIG. 3, the neck portion 108 may assume a substantially flattened state within the body portion 106 when stored. This may maximize a volume available within container 100 for storing liquid 102.

In the present embodiment, the closure is a piece of adhesive tape that holds opposite sides of the bag 101 together at the continuous fold 130. In particular, the tape covers the continuous fold 130 and is adhered to the opposite sides of the bag at or near the continuous fold 130. The tape is customized with a transverse tear strip 122 having a grippable hanging tab 124 designed to facilitate opening of the container 100 for liquid dispensing. The tear strip 122 and tab 124 may be adhesive-free on their container-facing sides. That is, the tape may have adhesive located exclusively or primarily on the tape halves 121, on opposite sides of tear strip 122 (see FIG. 3). It will be appreciated that the adhesive tape is pliable and that closure 120 may be considered as a form of pliable cover.

The example closure 120 forms a hermetic (i.e. airtight) seal at continuous fold 130. A hermetic seal may maximize hygiene by preventing even small particles or airborne microbes from reaching the neck portion 108 and mouth 110. The hermetic seal may also help prevent premature opening of the container 100 by bearing the brunt of any increase in internal liquid pressure should container 100 be squeezed before the closure 120 is removed. The seal provided by closure 120 may be designed to be stronger that the seal 112.

FIG. 5 is a perspective view depicting opening of example closure 120. A user may hold container 100 in one hand and use the thumb and forefinger of the other hand to grip hanging tab 124. By pulling upwardly on the tab 124, the user may tear away the tear strip 122 from the rest of the closure 120. As a result, the tape may separate longitudinally into two halves 121, which remain adhered to container 100.

The tear strip 122 may be designed to not completely detach from the closure 120. This may be achieved by anchoring the end of tear strip 122 that is opposite tab 124 to either one or both of the closure halves 121. The rationale for this design may be to reduce a risk of litter from detached tear strips. In some embodiments, the tear strip 122 may be fully detachable.

Figure 6:
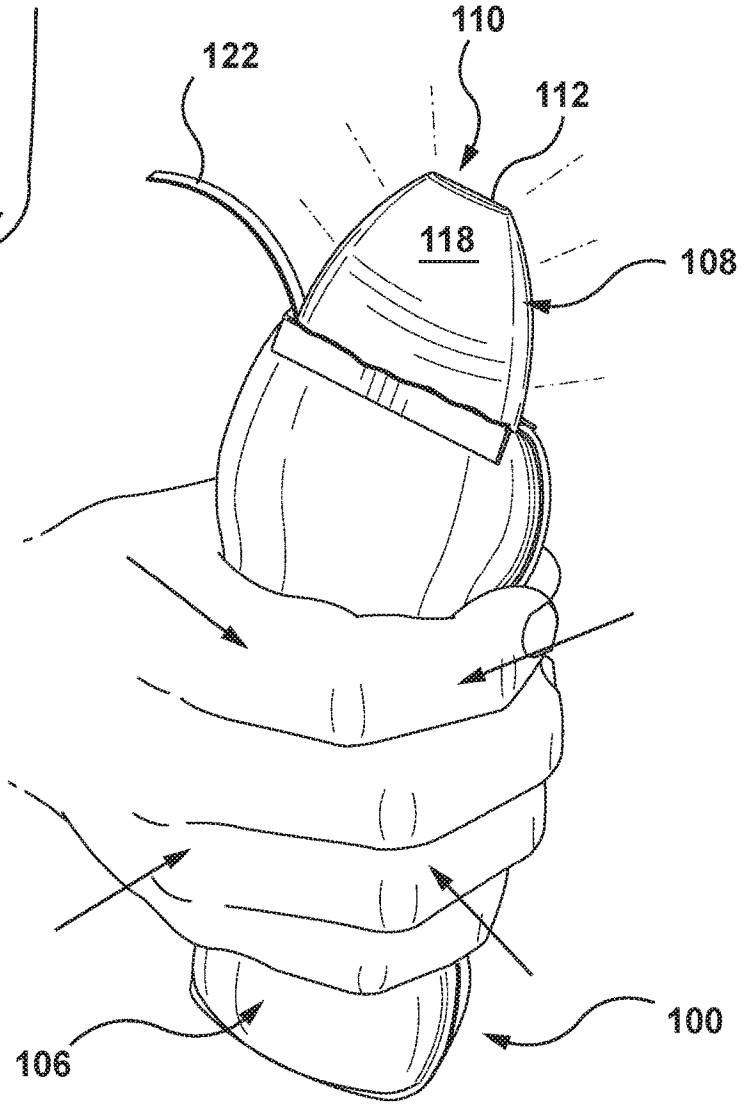
FIGS. 5, 6, and 7 are perspective views depicting a method of opening of the container of FIG. 1.

Referring to FIG. 6, once the closure 120 has been opened, the user may apply pressure to the body portion 106 of container 100 by squeezing it using his or her hand, as denoted in FIG. 6 by four inwardly directed arrows. The resultant increased pressure within the body portion 106 may cause the neck portion 108 to evert into its dispensing position, which in FIG. 6 points upwardly. It will be appreciated that eversion of the neck portion 108 causes the continuous fold 130 to disappear. Moreover, the everted neck portion 108 no longer has a flattened state as in FIG. 3 but rather has a full appearance permitting flow of liquid therethrough.

Figure 7:
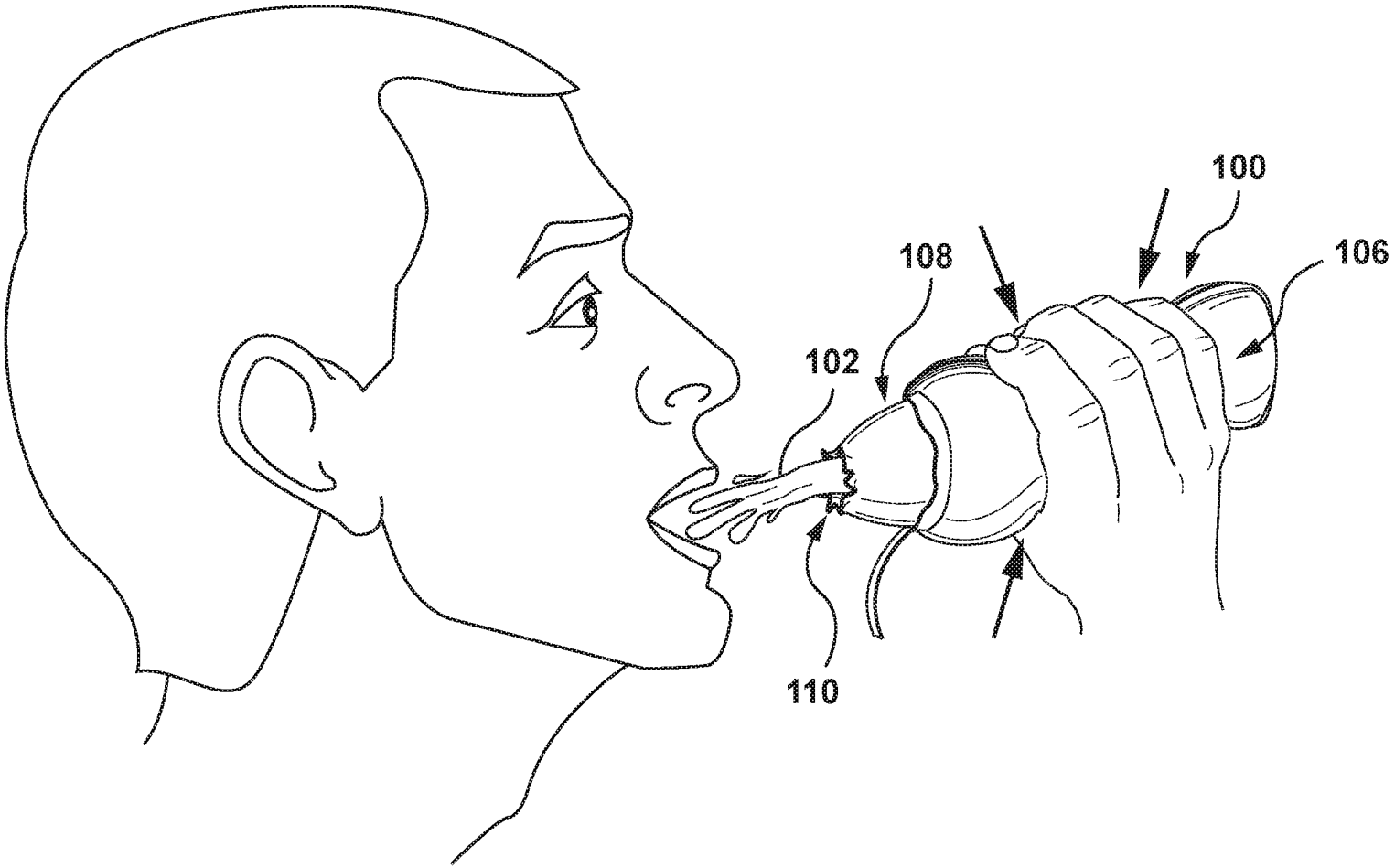

To consume liquid 102, the user may raise his or her hand so that the mouth 110 of container 100 is positioned proximate to or between the lips of the user, as shown in FIG. 7. It will be appreciated that, even if the body portion 106 of container 100 is not clean, the freshly everted neck portion 108 will be clean. The user may thus feel confident that any possible physical contact between his or her lips or mouth and the neck portion 108 will not compromise hygiene. Advantageously, this result is achieved without the need for removing and discarding a separate covering, such as a cellophane wrapper of a straw of a drink box. This limits the steps required to consume liquid and may avoid creation of additional waste.

To break the seal 112 of mouth 110 (i.e. to unseal the mouth 110), the user may squeeze the body portion 106 until the hermetic seal 112 bursts. Liquid exiting container 100 may immediately be consumed. The breaking of seal 112 by squeezing of container 100 may be considered convenient because no tools are required and because the seal 112 may be conveniently broken using the same hand that is being used to hold the container 100.

The above-described one-handed seal-breaking via squeezing may be facilitated by intentionally making the seal 112 the weakest point in container 100—e.g. weaker than both material 104 and any other seal or weld comprising container 100. To limit a risk of premature breakage of such an intentionally weak seal 112, the closure 120 may be designed to be stronger than seal 112. That is, closure 120 may be designed to be sufficiently strong to bear the brunt of any increased pressure within the container 100, and to thereby maintain a neutral or negligible pressure on seal 112, should the body portion 106 be inadvertently be compressed or squeezed prior to removal of the closure 120.

Although one-handed opening of seal 112 via squeezing of body portion 106 may be considered convenient, it is not absolutely required for the seal 112 to be broken in that way. In some embodiments, the seal 112 may be opened in other ways, e.g. by cutting of the seal 112 with scissors or tearing of the seal 112 along a predefined watertight tear line (not expressly depicted). In such embodiments, the seal 112 need not necessarily be the weakest point of container 100.

Once the liquid 102 in container 100 has been consumed, the empty container 100 may be discarded. It will be appreciated that the empty container 100 is easily compactible due to the flexibility of the material 104 from which it is made. Moreover, particularly in the case where the volume of contained liquid is relatively small (e.g. 50 ml), wastage of unconsumed liquid may be kept to a minimum because the liquid will have all been consumed.

Figure 8:
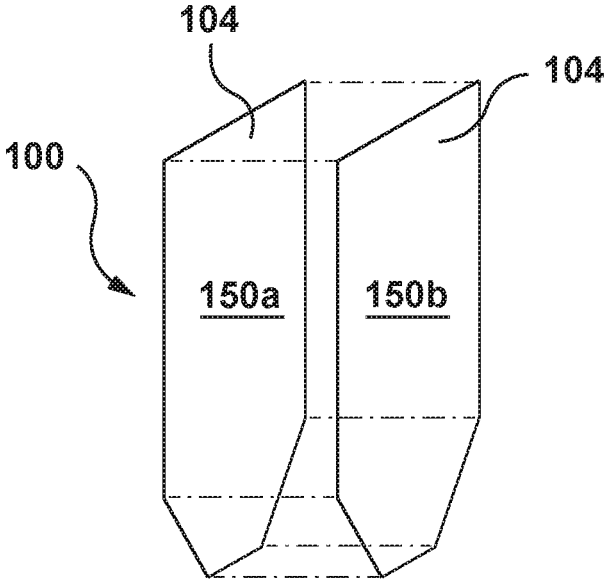
FIGS. 8, 9, 10, 11, 12, and 13 are perspective views depicting a method of manufacture of the container of FIG. 1.
Figure 9:
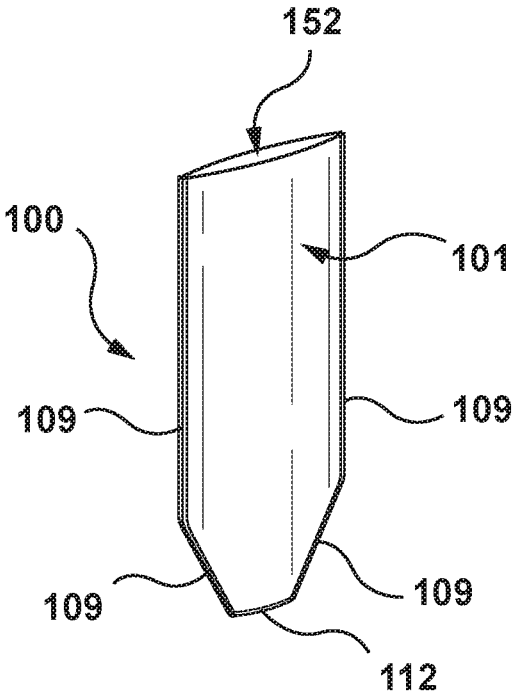

FIGS. 8-13 schematically depict one example method of manufacturing container 100. Referring to FIG. 8, two like panels 150*a*, 150*b* of liquid-impermeable material 104 are heat-welded or otherwise joined together along their edges. Each panel 150*a*, 150*b* may have the outline of the rectangular body portion 106 adjoined with substantially trapezoidal neck portion 108. Heat-welding may be performed in a similar manner as is used to manufacture commercially available food-storage (e.g. sandwich) bags at the time of this writing. Heat-welding may result in a peripheral seam or weld 109 (a form of hermetic seal), as shown in FIG. 9 (see also FIGS. 1 and 2).

A similar technique may be used to form hermetic seal 112 of mouth 110. As noted above, it may be desirable for seal 112 to be weaker than seal 109 in some embodiments to facilitate opening of the mouth 110 by squeezing of body portion 106. This may be done in various ways. For example, the welding technique used to create seal 112 may intentionally weld a narrower area than is welded when forming seal 109. Alternatively, a wholly different sealing technique (e.g. a food-grade adhesive) may be used for seal 112. However it may be performed, the joining of panels 150*a*, 150*b* results in the formation of a container 100 or bag 101.

Referring to FIG. 9, it can be seen that the end 152 of container 100 opposite the neck portion 108 (uppermost in FIG. 9) is intentionally left open. This opening 152 allows the container 100 or bag 101 to subsequently be filled with liquid 102 before being fully sealed.

It will be appreciated that, at this stage of manufacturing, the neck portion 108 of container 100 of FIG. 9 is in the everted or dispensing position. Subsequent operations for tucking the neck portion 108 into a stored position within the body portion 106 are shown in FIGS. 10-13.

Figure 10:
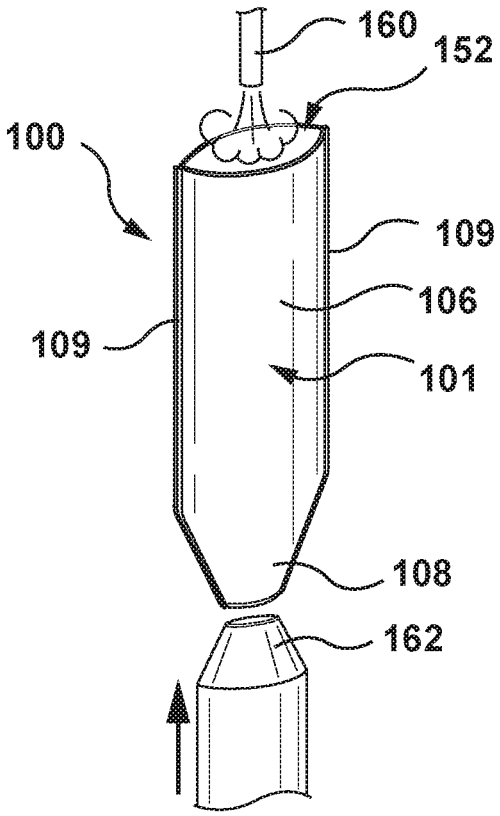
Figure 11:
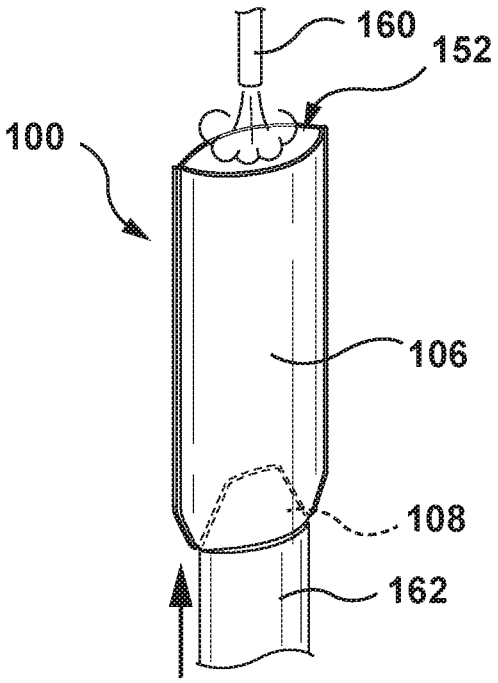

Referring to FIG. 10, it is presumed that the body portion 106 of container 100 or bag 101 is held in place e.g. at opposing seams 109. An air nozzle 160 blows air into open end 152, causing the container 100 or bag 101 to at least partially inflate to facilitate tucking. Simultaneously, a mandrel 162 near neck portion 108 moves towards container 100 (see FIG. 10). Continued movement of the mandrel 162 contacts, and ultimately pushes and tucks, the neck portion 108 into the body portion 106 in an inside-out state, e.g. as shown FIG. 11.

Figure 12:
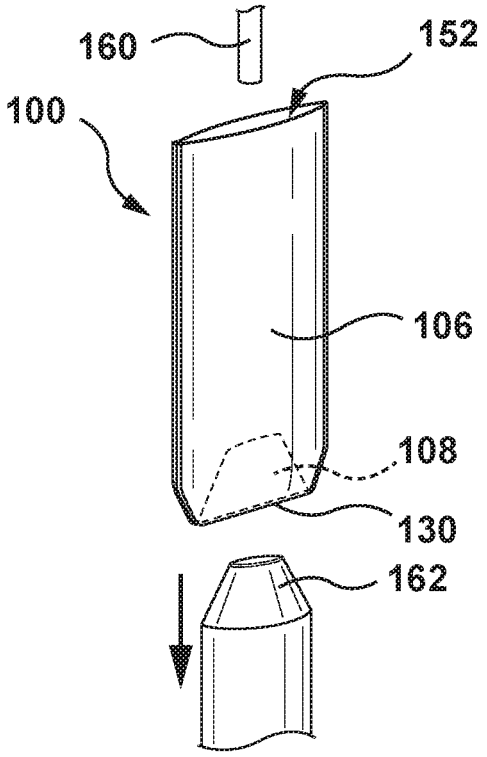
Figure 13:
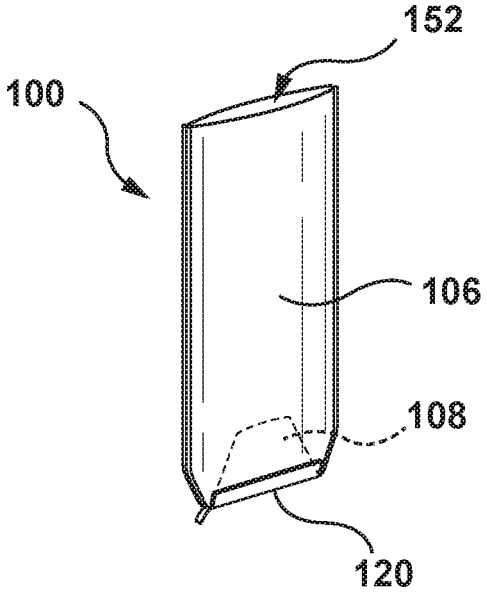

Once the neck portion 108 achieves the stored inside-out position, inflation of the container 100 or bag 101 may cease. The mandrel 162 may then be removed as shown in FIG. 12, leaving the neck portion 108 in the tucked position with a newly formed continuous fold 130 in container 100 (see FIG. 12). In some embodiments, the opening 152 may temporarily be held closed during removal of mandrel 162 to discourage eversion of the neck portion 108 during mandrel removal. Thereafter, closure 120 may applied at the continuous fold 130, as shown in FIG. 13.

At this stage, container 100 may be considered ready for filling with liquid 102 via opening 152. Filling may be performed immediately or at a later date, e.g. by an entity, such as a beverage company, different from the entity that manufactures the container 100. After container 100 has been filled, the opening 152 is hermetically sealed. The strength of the latter seal may be comparable to that of the earlier formed peripheral seal 109.

Figure 14:
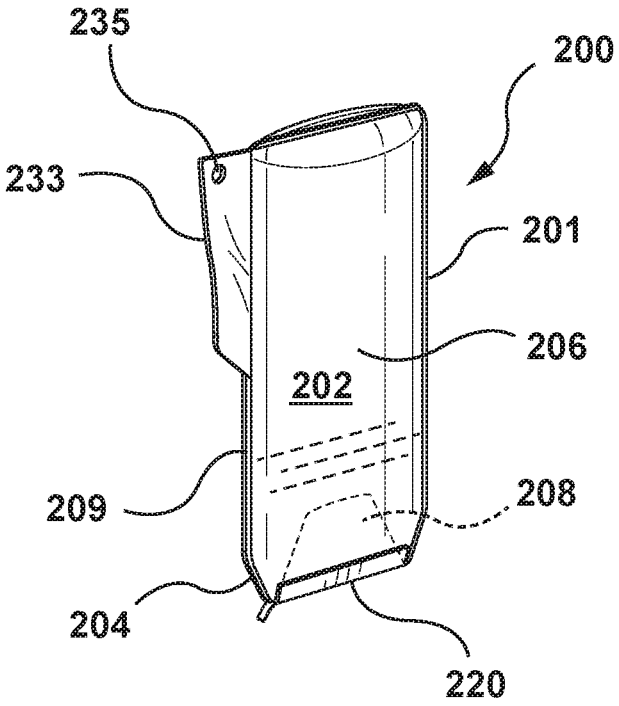
FIGS. 14 and 15 are perspective and elevation views respectively of an alternative embodiment of the disposable container.
Figure 15:
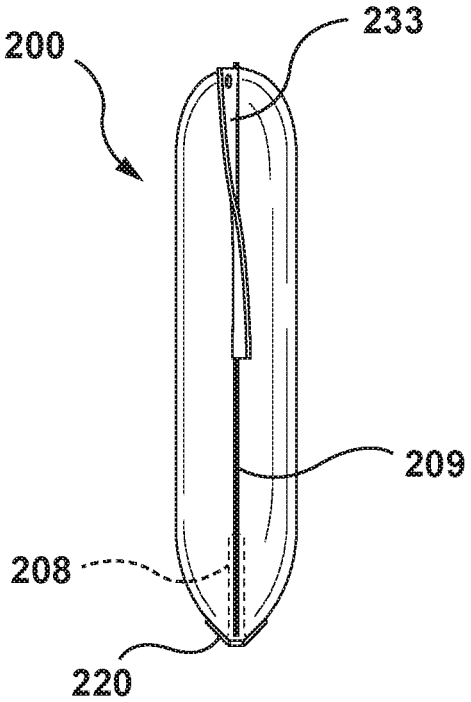

FIGS. 14 and 15 depict an alternative embodiment of container 200 in perspective and elevation view respectively. The container 200 is in many respects similar to container 100 of FIGS. 1-3. Container 200 comprises a bag 201 for storing a consumable liquid 202 having a body portion 206, neck portion 108, and closure 220 analogous to the elements of the same names of container 100 respectively. The bag 201 is made from a material 204 that may be similar to material 104, described above.

Additionally, container 200 has a wing 233 extending from seam 209. The wing 233 may be formed from the same liquid-impermeable material from which the container 200 is formed and is possibly made when seam 209 is formed (e.g. from the joining together of two sheets of the material from which the walls of container 200 are formed during heat-welding). The wing 233 may be semi-rigid and may be formed to have a longitudinal twist or bend, as best seen in FIG. 15. The wing 233 may also have a hole 235 therethrough.

Figure 16:
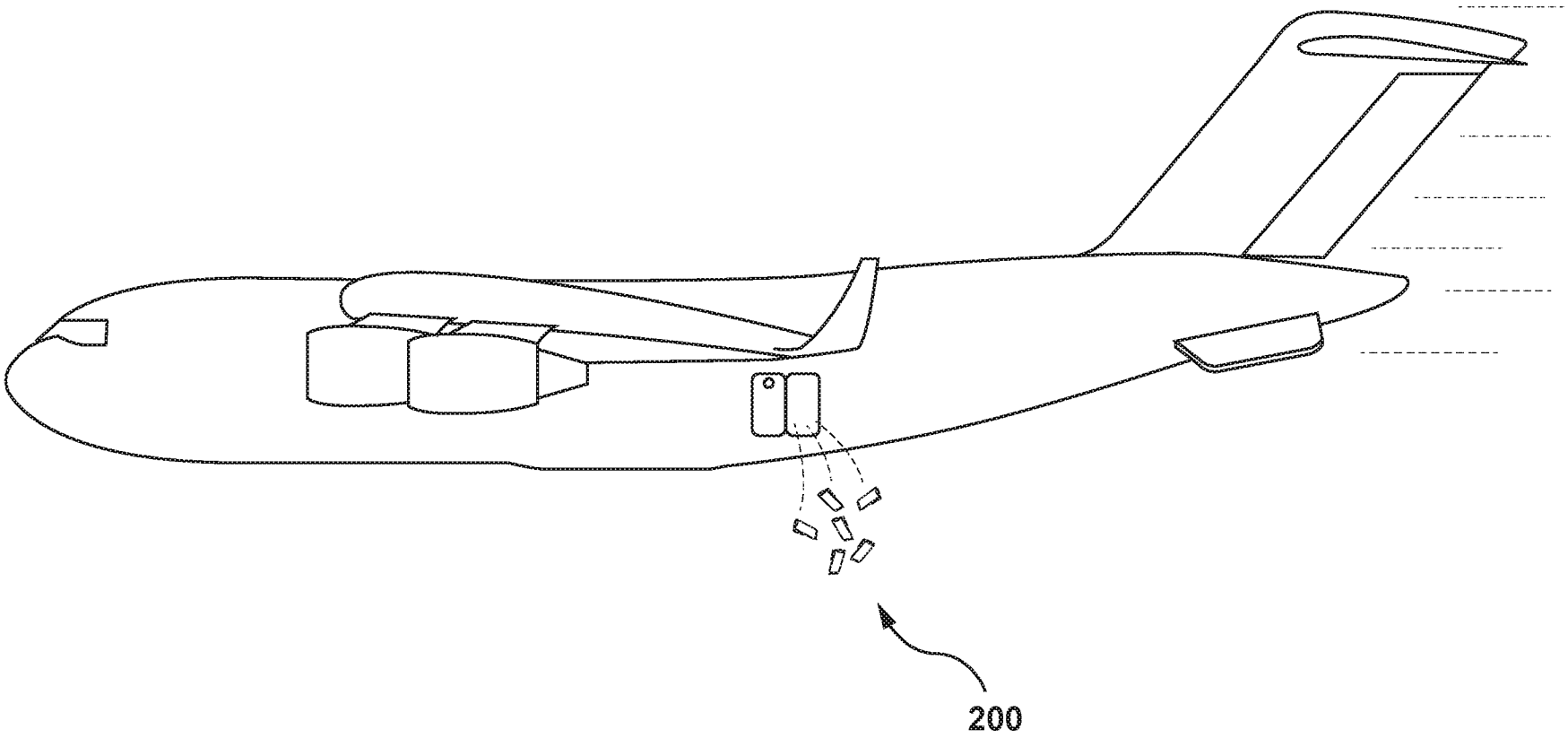
FIGS. 16 and 17 are schematic depictions of a possible method of distribution of the container of FIGS. 14 and 15.
Figure 17:
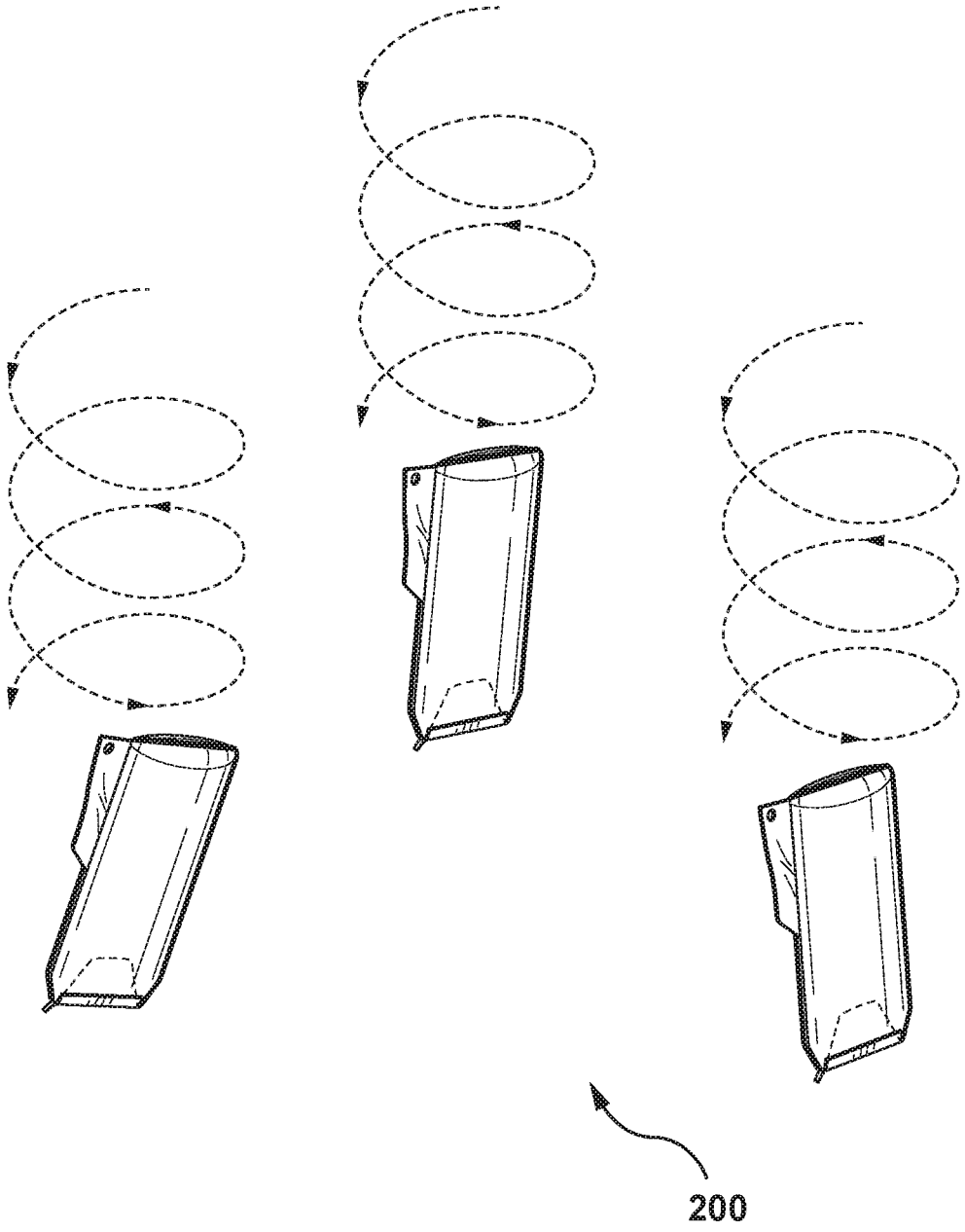

The purpose of wing 233 will become apparent from FIGS. 16 and 17, which depict a manner of distribution of containers 200. In circumstances where emergency supply of consumable liquids is warranted (e.g. in cases of natural disaster, war, or emergency), a plurality of individual containers 200 may be air-dropped from an airborne platform such as an airplane, helicopter, dirigible, or drone (see FIG. 16).

As the containers 200 begin to fall, increased air resistance on wing 233 relative to elsewhere on container 200 may cause each container 200 to spin or "helicopter" (see FIG. 17). The bend in wing 233 (FIG. 15) and/or an air pressure differential on opposing sides of the wing 233 may enhance this effect. Spinning may reduce the rate of descent of the containers 200 to a rate that will avoid or limit rupture when the containers 200 impact the ground. Of course, if the containers are intended for such distribution, which is optional, they should be made from a material of sufficient strength to avoid or limit their rupture when the containers are so dropped. Moreover, the seam 209 should be sufficiently strong to avoid blowout upon impact in such embodiments. It will be appreciated that, even if the containers 200 were to become dirty when so air-dropped, they may still be used to hygienically dispense liquid 102 due to the sanitary condition of the neck portions 208 upon their eversion. Distribution of the containers 100 or 200 may be performed in other ways.

For clarity, the size and shape of the wing 233 relative to that of the body portion 206 of container may vary between embodiments. When used, wings may be integrally formed with their respective containers or attached thereto. For example, in some embodiments the wing may be applied after formation and filling of container 200, e.g. using an adhesive. The wing in such embodiments may be formed from plastic or paper with a peel-away sticker portion for attaching the wing to the container.

Referring again to FIG. 14, the hole 235 in wing 233 may facilitate carrying of the container 200 regardless of whether the container 200 is air-dropped. Specifically, the hole 235 may facilitate attachment of the container 200 to a belt or backpack of a user, e.g. via a clip, string, or zip tie. For example, a jogger may find it convenient to carry several containers 200 attached to a belt or strap for detachment and use as required. The containers 200 in that case may be filled with a sports drink.

As earlier described, the example closure 120 of FIG. 1 can be opened using two hands: one for holding the container 100 and the other for tearing away tear strip 122 of closure 120 (see FIG. 5). For some applications, the use of two hands for opening closure 120 may be considered inconvenient.

Figure 18:
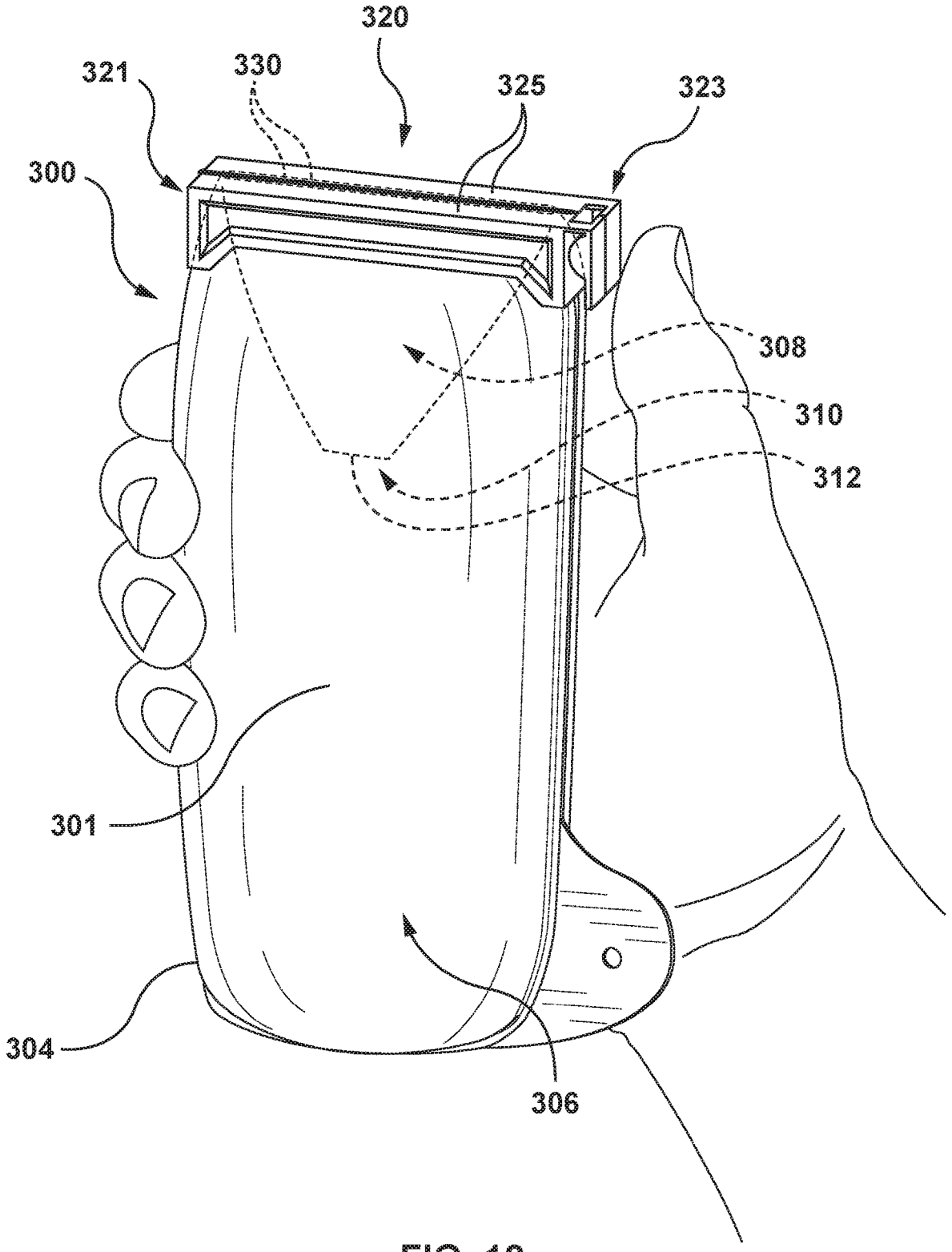
FIG. 18 is a perspective view of another example disposable container.

FIG. 18 depicts, in perspective view, an alternative disposable container 300 having a closure 320 that can be opened using only one hand, e.g. using a thumb of the same hand that holds the container 300. The container 300 is depicted in a filled state, i.e. containing a consumable liquid 302 (see FIG. 21), prior to opening.

With the exception of the closure 320, container 300 of FIG. 18 is in many respects similar to container 100 of FIG. 1. For example, container 300 comprises a bag 301 having a flexible body portion 306 in fluid communication with a flexible neck portion 308. The body and neck portions 306, 308 are analogous to body and neck portions 106, 108 respectively of FIG. 1 and may similarly be made from a similar material 304, such as a sheet of polymer material as described above. The neck portion 308 is tapered and has a distal mouth 310 closed by a hermetic seal 312. The seal 312 may intentionally be the weakest point of container 300.

In FIG. 18, the neck portion 308 is depicted in a stored position, tucked inside-out within, and extending inwardly into, body portion 306. The tucking or storing of neck portion 308 inside-out within the interior of body portion 306 results in a continuous fold 330 in the bag 301, which may be similar to the continuous fold 130 shown in FIG. 4 for example.

The closure 320 of FIG. 18 fulfills a similar purpose to the closure 120 of FIG. 1, namely keeping neck portion 308 in the stored position and shields it from external contaminants prior to container use. However, unlike closure 120, the closure 320 is designed to be openable using only one hand. In this context, "openable" refers to the capacity of the closure 320 for attaining a state in which the neck portion 308 can be everted into a dispensing position.

Figure 19:
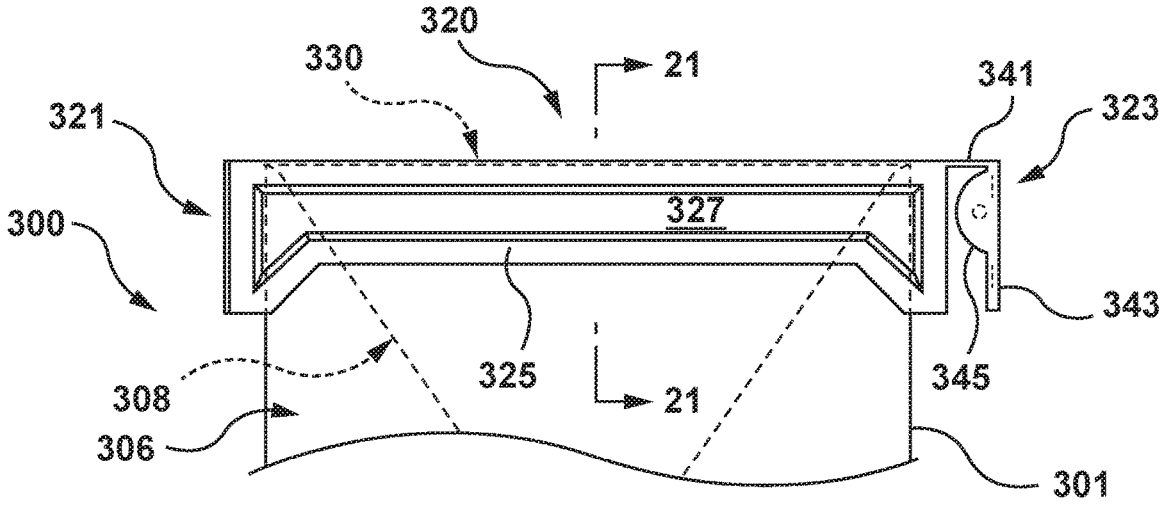
FIG. 19 is a side elevation view of the closure of the disposable container of FIG. 18.
Figure 20:
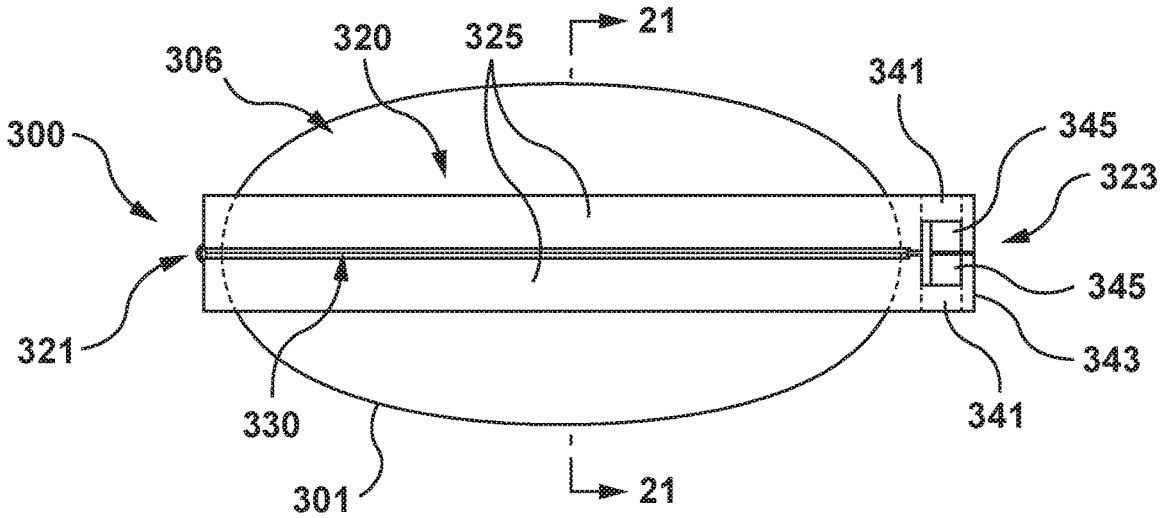
FIG. 20 is a top plan view of the closure of the disposable container of FIG. 18.
Figure 21:
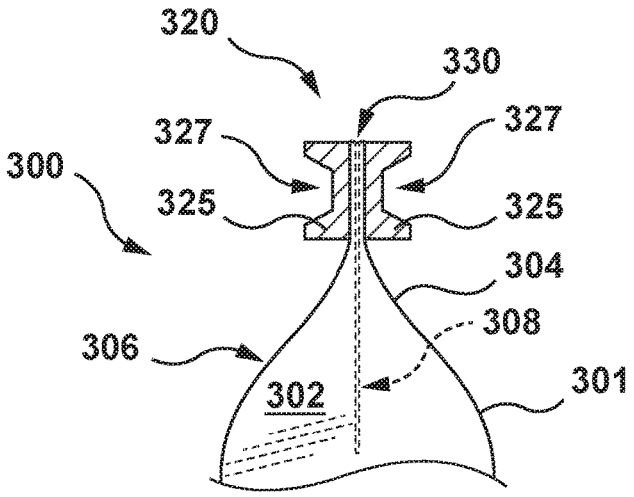
FIG. 21 is a transverse cross-section side view of the closure of the disposable container of FIGS. 19 and 20 taken along line 21-21.

The example closure 320 is shown in side elevation view in FIG. 19 and in top plan view in FIG. 20. A cross section of the closure 320 taken along line 21-21 in FIGS. 19 and 20 is illustrated in FIG. 21.

As perhaps best seen in FIG. 20, the example closure 320 comprises an elongate clip including a pair of arms 325 with a hinge 321 at one end and a release mechanism 323 at the other. The release mechanism 323 connects the distal ends of arms 325 in fixed relation to one another, with the arms 325 parallel to one another, either abutting or very close together. In that state, the opposing inner faces of the arms 325 cooperate to pinch or hold the continuous fold 330 of container 300 therebetween and thereby keep the neck portion 308 tucked and in a hygienic condition (see e.g. FIGS. 20 and 21).

The release mechanism 323 is designed to break the fixed relationship between the distal ends of arms 325 when pressed and to thereby allow the closure 320 to open. In the illustrated embodiment, the release mechanism 323 achieves this result by breaking away fully from the distal ends of both arms 325 when pressed with sufficient force. The piece that breaks away is referred to therein as the "breakaway piece" of mechanism 323. Prior to being broken away, the breakaway piece bridges the distal ends of the arms 325. In some embodiments, the release mechanism 323 breaks away from only one of the distal ends but remains attached to the other. This may help to reduce waste or litter when the container 300 is used.

In the present embodiment, the release mechanism 323 is connected to the distal ends of the two arms 325 by two breakable strips 341 respectively (see e.g. FIG. 20). The breakable strips 341 may be integrally formed with the arms 325 and the mechanism 323 and may have a thin profile or transverse perforation (not expressly depicted) to facilitate breakage. Strips 341 may be referred to more generally as breakable elements 341. Other embodiments may employ different forms of breakable elements besides strips (e.g. posts).

The breakaway piece includes a tab 343 and an inwardly projecting nub 345, which are designed to act as lever and fulcrum elements respectively during opening of the closure 320. The tab 343 extends in the direction of body portion 306, i.e. downwardly in FIG. 19, from the breakable strips 341, at about a right angle to the arms 325. The nub 345 may be positioned closer to the strips 341 than to the distal end of tab 343 for leverage, e.g. to magnify a force applied to the distal end, as will be described.

In the example closure 320, each arm 325 has a longitudinal recess 327 defined in its outer face (see e.g. FIGS. 19 and 21). The recesses 327 conserve the material from which the closure 320 is made (e.g. plastic) without unduly sacrificing structural strength of arms 325. The recesses 327 are not necessarily present in alternative embodiments.

Figure 22:
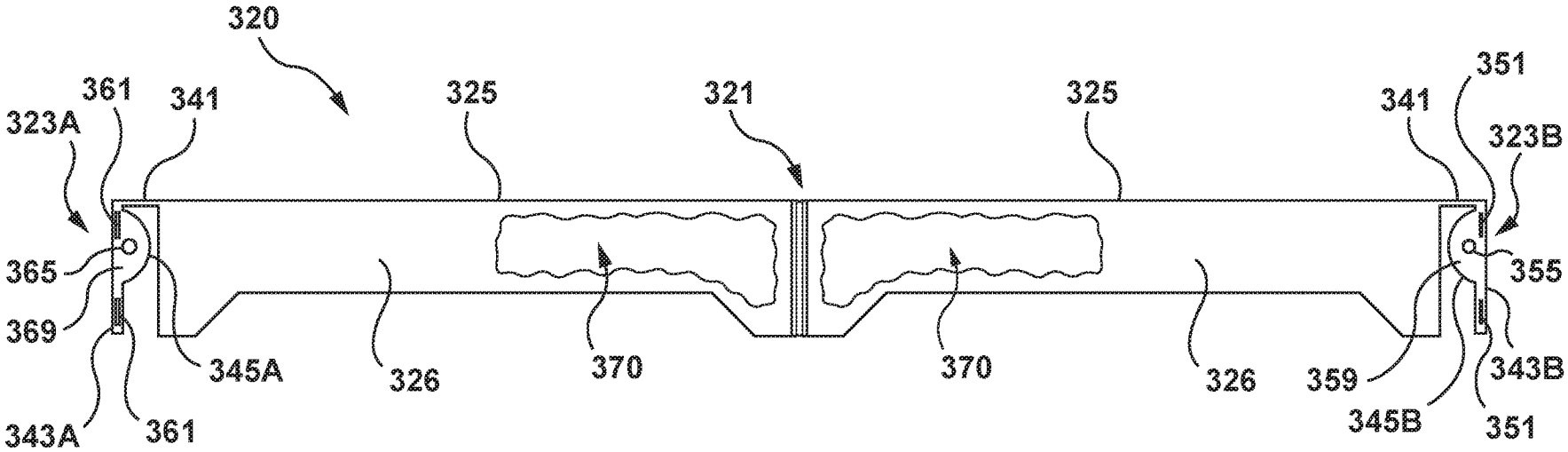
FIGS. 22 and 23 are side elevation and top plan views respectively of the closure of FIGS. 19-21 in a fully opened state prior to its attachment to the bag portion of the disposable container of FIG. 18.
Figure 23:
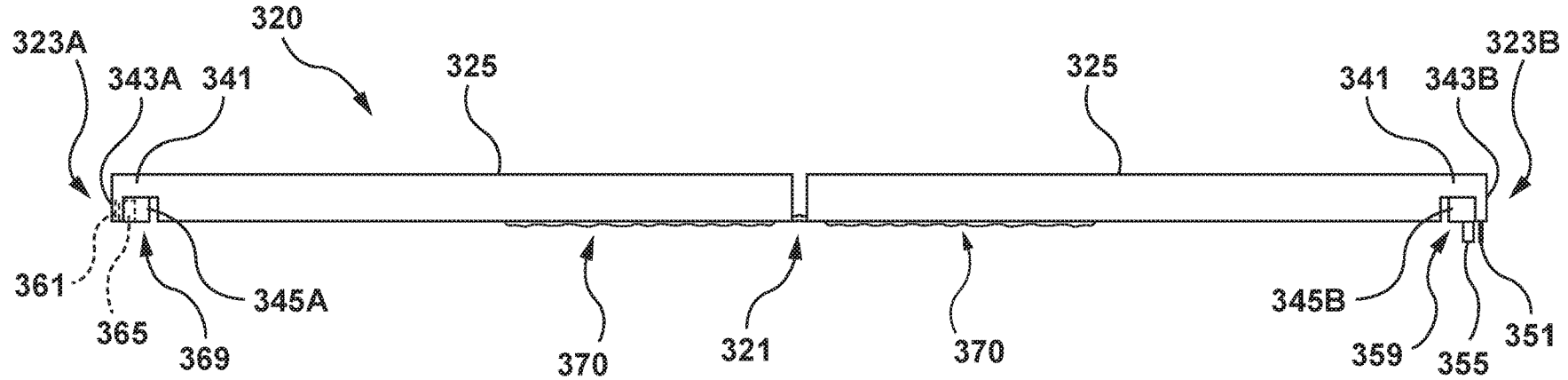

FIGS. 22 and 23 depicts the example closure 320 of FIGS. 19-21, in side elevation view and top plan view respectively, in a fully opened state, i.e. with the hinge 321 opened 180 degrees, prior to application of the closure 320 to the bag 301. The closure 320 may for example be formed as a single piece, e.g. via injection molding of plastic.

As illustrated, the release mechanism 323 is longitudinally bifurcated into two complementary halves 323A, 323B, which may be referred to as the female and male halves respectively. A distal end of each half 323A, 323B of the mechanism 323 is connected to a respective one of the two breakable strips 341. The female half 323A of release mechanism 323 includes a portion 343A of tab 343 and a portion 345A of nub 345. The male half 323B of release mechanism 323 includes a complementary portion 343B of tab 343 and a complementary portion 345B of nub 345.

As best seen in FIG. 22, a pair of connector tabs 351 and a connector pin 355 extend orthogonally from a mating surface 359 of the male half 323B of release mechanism 323. The complementary mating surface 369 of the female half 323A of release mechanism 323 has a pair of connector slots 361 and a connector hole 365 defined therein, which are complementary to, and aligned with, the tabs 351 and pin 355 respectively. The connector tabs 351 and connector pin 355 are sized and positioned for mating with slots 361 and hole 365 respectively when the closure 320 is folded in half at hinge 321. In some embodiments, a single protuberance (e.g. tab or pin) and complementary receptacle (e.g. slot or hole) may take the place of multiple protuberances/receptacles. Mating may hold the halves 323A, 323B together by friction. To the extent that analogous release mechanism halves are present in alternative embodiments, they may be connected together in other ways besides mating of one or more protuberances with one or more complementary receptacles.

In the illustrated embodiment, an adhesive material 370 is applied to a section of arms 325 proximal to hinge 321 prior to folding of the closure 320 onto the bag 301. The adhesive material 370, which may be a food-grade adhesive, facilitates adherence of the closure 320 to the bag 301 regardless of the open or closed status of the closure 320. In the present embodiment, the adhesive 370 is applied primarily or solely to the proximal section of the arms 325 (proximal to hinge 321) to ensure that the distal ends of arms 325 are free to separate from one another during the opening of closure 320.

Referring to FIGS. 22 and 23, it will be appreciated that the faces 326 of the arms 325 to which the adhesive material 370 is applied will oppose one another when the closure 320 is folded in half at hinge 321. For that reason, the faces 326 may be referred to as inside faces 326. In the depicted embodiment, the inside faces 326 are flat. In alternative embodiments, the faces 326 may define complementary relief features that cooperate to pinch or grip bag 301 therebetween in such a way that the pinched portion is not flat (i.e. incorporates at least one bend). This may reduce a risk of unexpected or premature separation of closure 320 from bag 301 before the closure 320 is opened. For example, one of the faces 326 may have an elongate longitudinal indentation defined therein, and the other face 326 may have a protuberant longitudinal ridge complementary to the indentation. When the closure 320 is folded in half, the indentation and ridge may become mated with the bag 301 pinched or gripped therebetween.

Figure 24:
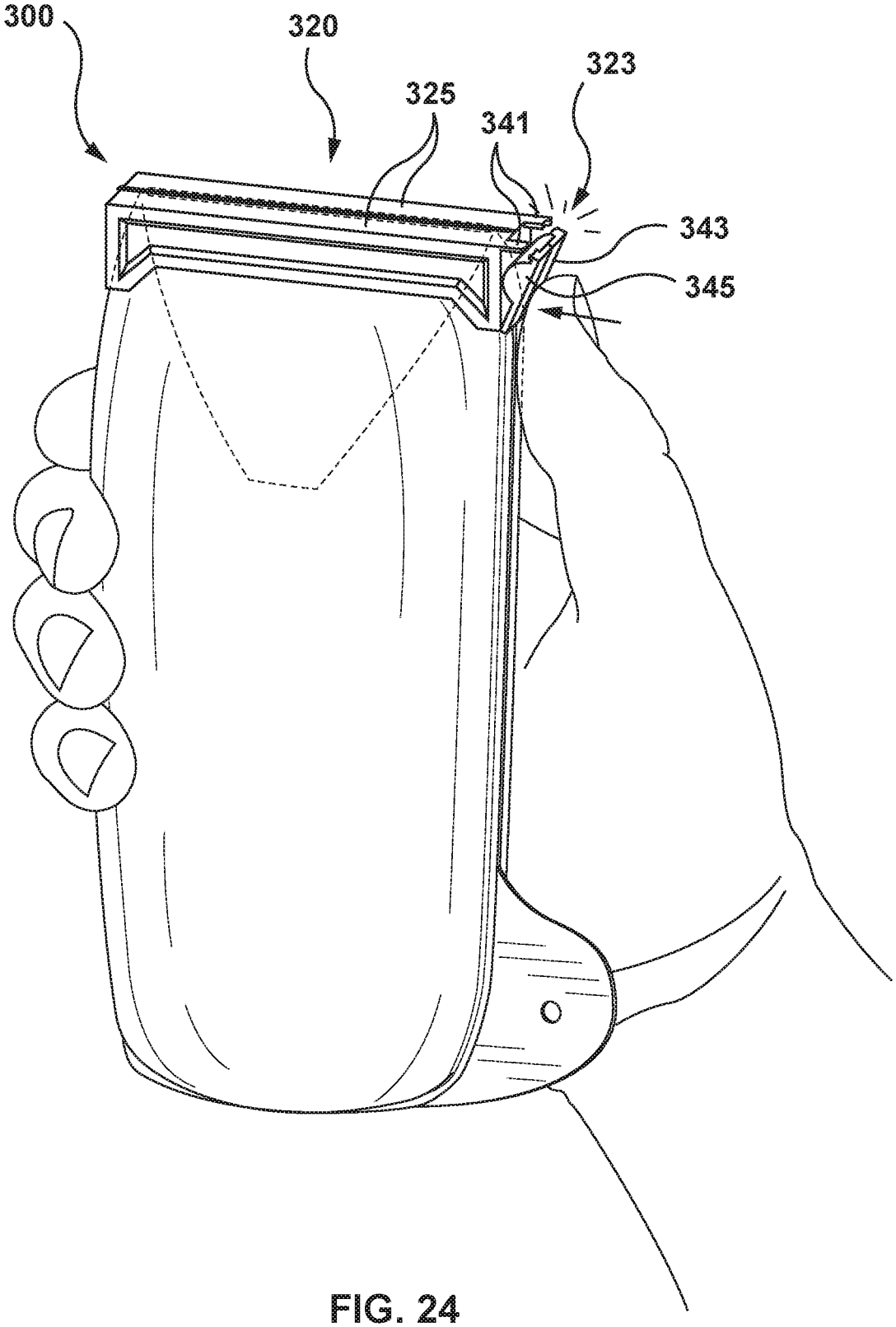
FIGS. 24, 25, 26 and 27 are perspective views depicting a method of opening of the container of FIG. 18.

FIGS. 24-27 depict, in perspective view, a method of opening container 300. Referring to FIG. 24, a user holding container 300 in one hand may use the thumb of the same hand to depress the distal end of tab 343 of release mechanism 323, i.e. to push the lower end of tab 343 inwardly towards the rest of closure 320, i.e. towards container 300. The pressure may initially cause the tab 343 to flex slightly towards container 300 until the nub 345 contacts the ends of arms 325. At this stage nub 345 begins to act as a fulcrum, converting any further inward force (pressure) upon to the distal end of tab 343 (which acts as a lever) to tensile force upon breakable strips 341. Positioning nub 345 closer to strips 343 than to a distal end of tab 343 may result in a magnification of the tensile force relative to the pushing force by virtue of leverage.

When the tensile force overcomes the tensile strength of strips 341, breakage of either one or both of the breakable strips 341 will result. In the illustrated embodiment of FIG. 24, it is presumed that both strips 341 have broken, causing the breakaway piece of the depressible release mechanism 323 (including tab 343 and nub 345) to partially or fully break away from the remainder of the closure 320.

Figure 25:
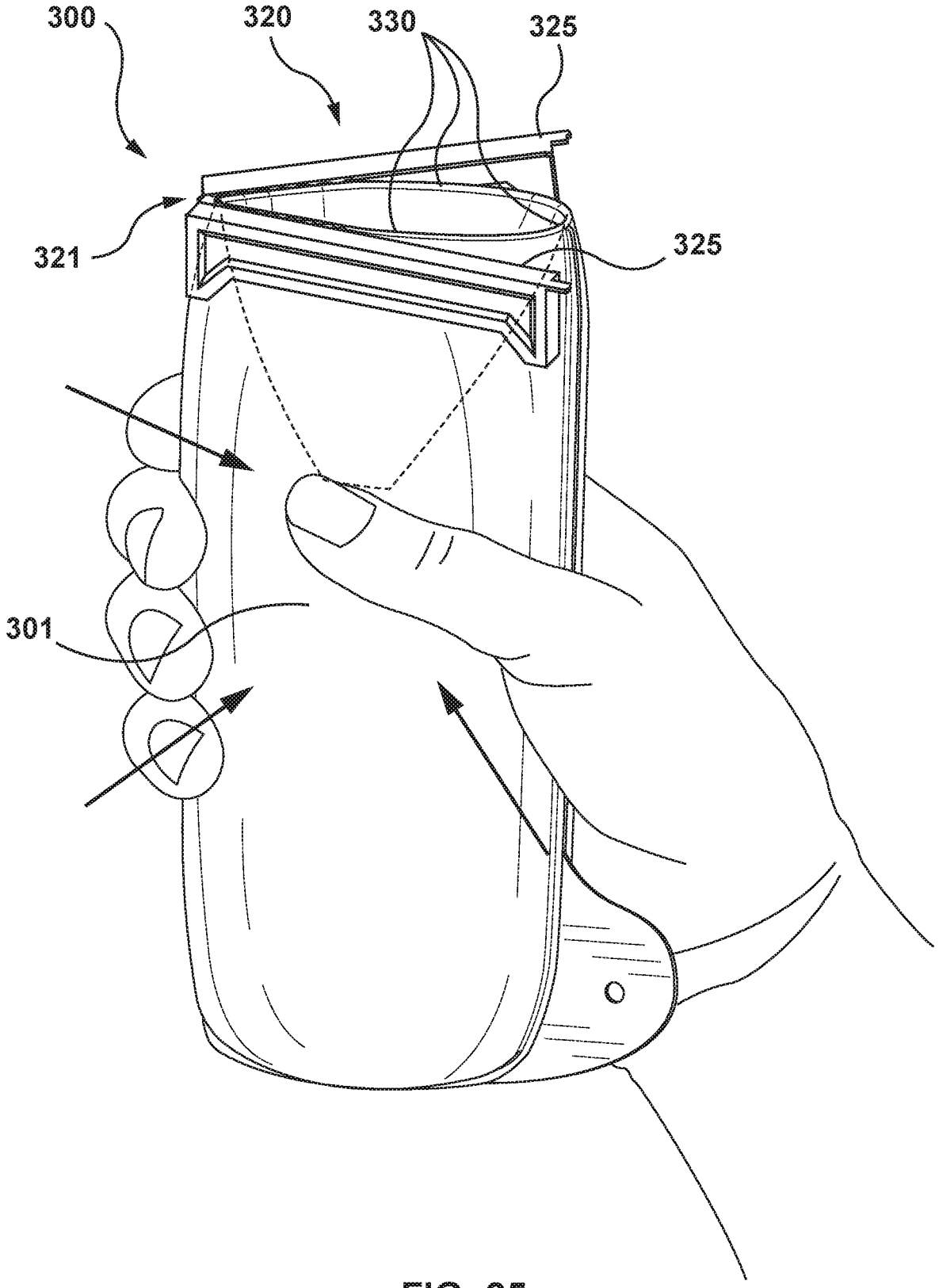

Because strips 341 are broken, the distal ends of the arms 325 of closure 320 are no longer held together. The arms 325 may accordingly spread apart or pivot away from one another at hinge 321 to release the continuous fold 330, as shown in FIG. 25 for example. The user may encourage the spreading apart by applying a degree of pressure upon the body 306 of the container 300; this may cause the upper portion of the bag 301, at or near the continuous fold 330, to become at least partially engorged with liquid 302, which in turn may facilitate opening of the closure 320. It will be appreciated that adhesion of only the proximal ends of arms 325 to the bag 301 by adhesive 370 allows the arms 325 to separate somewhat but may eventually limit their degree of separation. Because the distal ends of the arms 325 are not adhered to the bag 301, a gap may form between the distal ends and the continuous fold 330.

Figure 26:
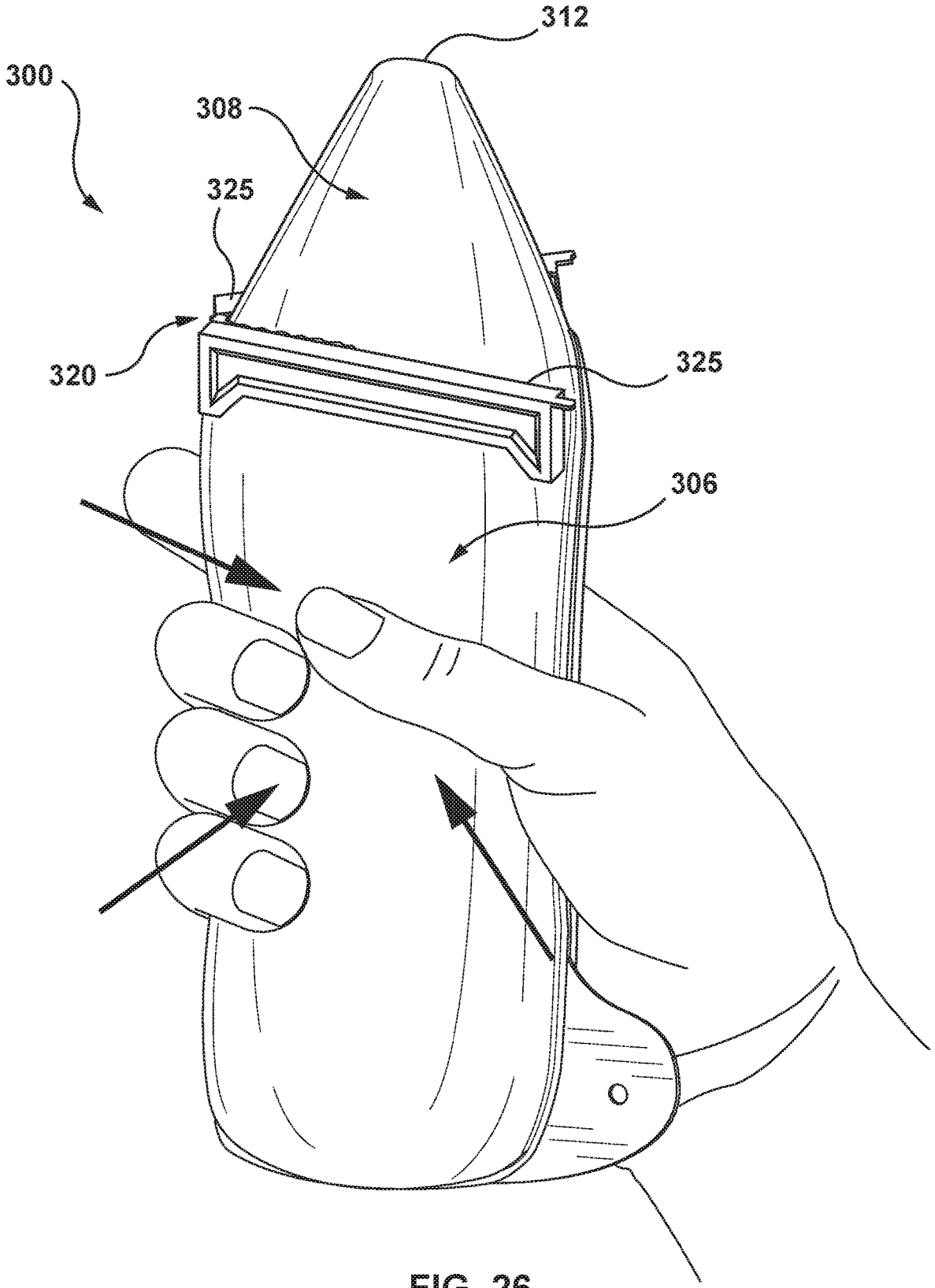

Referring to FIG. 26, once the closure 320 has been so opened, the user may apply additional pressure to the body portion 306 of container 300 by squeezing it more firmly with the same hand, as denoted in FIG. 26 by heavier arrows. The resultant increased pressure within the body portion 306 may cause the neck portion 308 to evert into its dispensing position, which in FIG. 26 points upwardly. It will be appreciated that eversion of the neck portion 308 causes the continuous fold 330 to disappear. The everted neck portion 308, which will be in a hygienic state, may attain an at least partially engorged appearance due to flow of liquid 302 thereinto.

Figure 27:
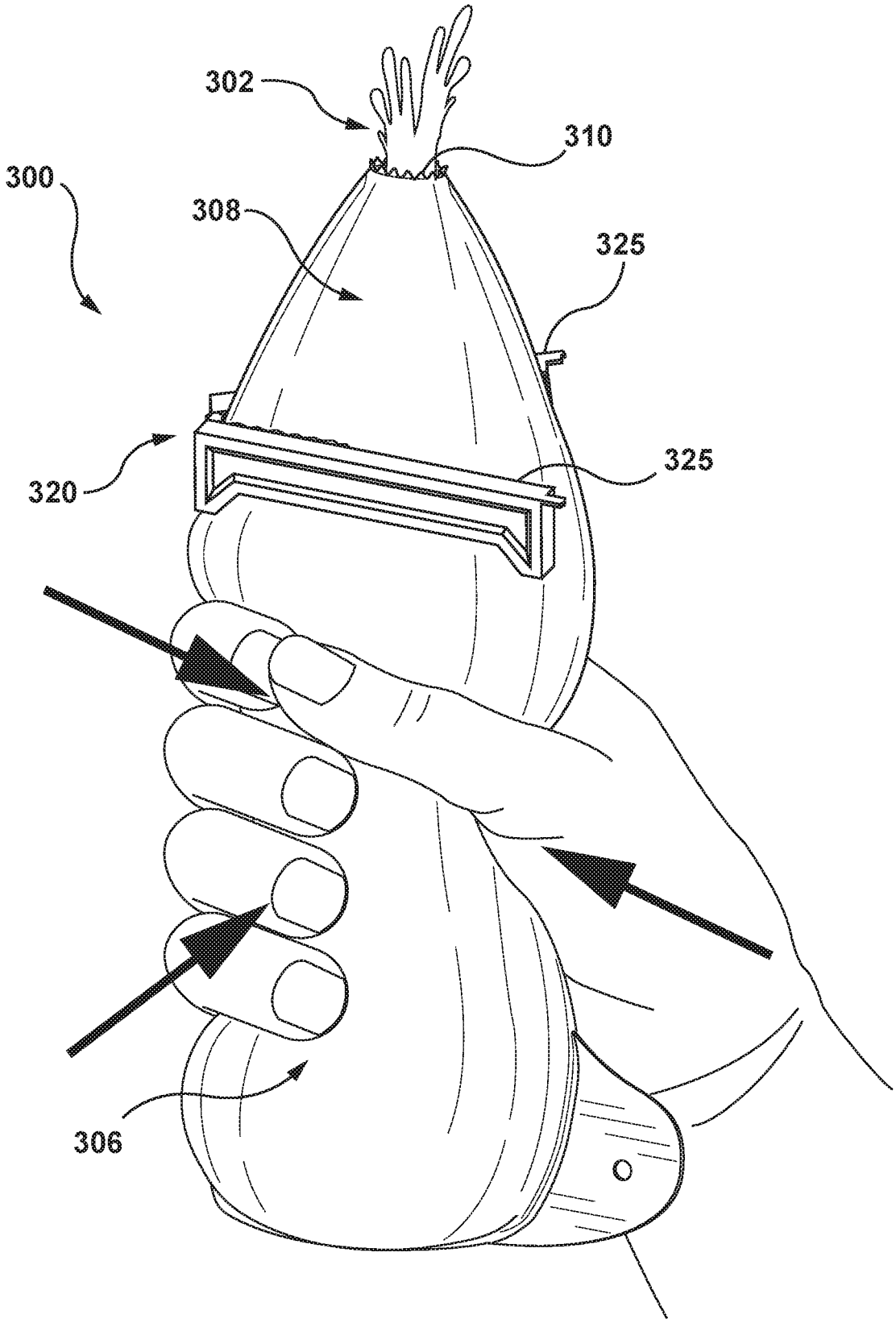

To begin consuming the liquid 302 in container 300, the user may squeeze the body portion 306 still more firmly, as denoted by bold arrows in FIG. 27, until the hermetic seal 312 bursts. Although not expressly depicted in FIG. 27, the user may first raise his or her hand towards his or her mouth 110, so that the mouth 310 of container 300 is positioned proximate to or between the lips of the user, e.g. similar to what is shown in FIG. 7, before the seal 312 is broken. Liquid 302 exiting container 300 may immediately be consumed.

The breaking of seal 312 by squeezing of container 300 may be considered convenient because no tools are required and because the seal 312 may be conveniently broken using the same hand that was used to open closure 320, evert dispensing portion 308, and hold the container 300. However, it is not absolutely required to break the seal 312 in that way. In alternative embodiments, the seal 312 may be broken in other ways, e.g. by cutting, or by tearing along a predefined structural feature such as a tear line.

The example release mechanism 323 described above may be referred to as a depressible release mechanism by virtue of the manner in which it is opened. In some embodiments, the release mechanism may be release in other ways besides being depressible, e.g. such as by upward prying.

As should now be appreciated, containers 100, 200, and 300 promote efficient use of liquid-impermeable material 104, 204, and 304. In particular, the material 104, 204, 304 comprising body portion 106, 206, 306 respectively may be considered as having a dual purpose. Firstly, material 104, 204, 304 defines a wall of body portion 106, 206, 306 for storing liquid 102, 202, 302. Secondly, at least a portion of the same material 104, 204, 304 acts as a cover for the neck portion 108, 208, 308 respectively when the latter is in the stored position. As a result, the container need not employ a separate component for the latter purpose. This may in turn reduce material costs and limit the weight of the container in at least some embodiments.

For clarity, the consumable liquid 102, 200, and 302 stored in container 100, 200, 300 respectively may be of virtually any viscosity, e.g. water, a beverage, a condiment, syrup, fruit puree, gel, or a medicine.

Various alternative embodiments are possible.

In some embodiments, the tucking of neck portion 108, 208, 308 and the application of closure 120, 220, 320 may be performed after the container 100, 200, 300 has been filled with liquid 102, 202, 302. In such embodiments, the liquid 102, 202, 302 may serve a similar purpose to the blown air in FIGS. 10 and 11, i.e. causing the bag to become filled to facilitate tucking. In such embodiments, use of an air nozzle 160 during manufacture may be unnecessary. However, application of the closure 120, 220, 320 may need to be performed immediately after or overlapping with the withdrawal of the mandrel, so that the weight of the contained liquid does not cause the neck portion to evert before the closure 120, 220, 320 can be applied.

When a container 100, 200, or 300 is manufactured, the portion left open for filling of the container 100 with liquid 102 is not necessarily the bottom of the container opposite the neck portion 108, 208, 308 (e.g. opening 152, FIG. 13). In alternative embodiments, a different area of the container 100, 200, 300 may be left open to allow the container to be filled with liquid 102, 202, 302.

Alternative embodiments of closures to those described above may be used. One alternative embodiment of closure may be a zip-to-seal (e.g. Ziploc™) or hook-and-loop (e.g. Velcro™) closure. Complementary halves of such closures may be attached to the bag forming part of the container, at opposite sides of the continuous fold, so that the halves face one another when the neck portion is in the stored position. When mated, the complementary halves of this closure would hold the opposite sides of the bag together. When separated, the complementary halves would permit eversion of stored neck portion therebetween, upon squeezing of the body portion for example. In a further alternative, the closure may be a form of removable clip.

Another alternative embodiment of closure may be a pliable cover other than adhesive tape. The pliable cover could for example be a strip of sealant, such as silicone or wax, that is sufficiently strong to hold the opposites sides of the bag together at the continuous fold even upon the application of external forces upon the container. The strip of sealant may cover the continuous fold and may be affixed to or bonded with the opposite sides of the bag at or near the continuous fold. In such embodiments, a tear strip similar to tear strip 122 could be embedded in the sealant to facilitate opening in a similar manner to what is shown in FIG. 5.

In some embodiments, the closure could be a cover, similar to the pliable covers described above, that is non-pliable. Examples may include a strip of rigid plastic or a rigid piece of natural material (e.g. bamboo) which covers the continuous fold and generally serves the same purpose as the closures described hereinabove (e.g. hold together the opposite sides of the bag and shield the neck portion and mouth from external contaminants).

It will be appreciated that, although all of the various closure embodiments described above do shield the neck portion and mouth of the container from external contaminants, the degree to which this result is achieved may vary slightly between embodiments. For example, a closure comprising an elongate clip (e.g. closure 320 of FIG. 18) may so tightly pinch or grip the bag at the continuous fold that even microbe-scale particles may be unlikely to enter. In contrast, a closure embodiment comprising an adhesive tape (e.g. closure 120 of FIG. 1), if made from a woven material, may have minute spaces therein, between the threads comprising the weave for example. That closure may be effective in keeping the vast majority of dust, dirt, and airborne particulates away from the neck portion but could in theory allow microbe-sized particles to pass by virtue of not providing a strictly hermetic seal. For some applications, this degree of sanitary protection may be sufficient.

Yet, for other applications, e.g. uses of the container in medical environments (if the stored liquid is a medicine for example), it may be desired to provide a supplementary barrier, in addition the closure—presuming the closure itself is not wholly suitable for that purpose—to maximize sanitary protection. The supplementary barrier may for example be better suited than the closure for protecting against microbial contamination. Collectively, the closure and supplementary barrier may be considered to provide two tiers of protection from external contamination. Moreover, the use of both may be justified because each may have strengths the other lacks. For example, the closure may be more rugged, i.e. better able to withstand external forces and still keep the neck portion in the stored position, but may not fully prevent passage of small, e.g. microbe-sized, particles. Conversely, the supplementary barrier may be physically weaker yet more effective at blocking small particles such as microbes.

If present, the supplementary barrier may take various forms. In some embodiments, the barrier could be a bead of food-grade pliable sealant (e.g. wax or silicone) in the gap between the opposite sides of the bag at the continuous fold. In other embodiments, the supplementary barrier could be a weak glue or adhesive applied to at least one, and possibly both, of the opposite sides of the bag at the continuous fold, to permit those opposite walls to be stuck together. The supplementary barrier may provide an airtight or hermetic seal between opposing walls 118 (see e.g. FIG. 3A) to isolate the stored neck portion and mouth from the environment. To simplify opening of the container, the supplementary barrier may be designed to yield or break, after the closure has been opened or removed, when the body portion of the container is squeezed.

The neck portion of the bag may have various shapes. For example, if the general shape (profile) of the bag is rectangular when empty, one of the corners of bag could serve as the neck portion. For a bag having a generally circular shape when empty, a segment of the circle could act as the neck portion. Many different configurations are possible.

Additional aspects are recited in the clauses that follow.

Clause 1. A disposable container for hygienic dispensing of a consumable liquid, comprising: a bag made from a flexible, liquid-impermeable material, the bag having a flexible body portion for containing a consumable liquid and a flexible neck portion with a hermetically sealed mouth, the mouth for dispensing the consumable liquid upon when opened, the neck portion being in a stored position tucked inside-out inside the body portion, the tucking resulting in a continuous fold in the bag; and a closure for holding together opposite sides of the bag at the continuous fold to maintain the neck portion of the bag in the stored position, tucked inside-out within the body portion, and to shield the neck portion from external contaminants pending opening or removal of the closure and eversion of the neck portion into a dispensing position.

Clause 2. The disposable container of clause 1 wherein the closure comprises a piece of adhesive tape covering the continuous fold, the adhesive tape being adhered to the opposite sides of the bag at or near the continuous fold.

Clause 3. The disposable container of clause 2 wherein the closure comprises a tear strip along the adhesive tape for opening the closure and thereby permitting eversion of the neck portion into the dispensing position.

Clause 4. The disposable container of clause 1 wherein the closure comprises silicone or wax covering the continuous fold and affixed to the opposite sides of the bag at or near the continuous fold.

Clause 5. The disposable container of clause 1 wherein the hermetically sealed mouth is configured as the weakest point of the bag so that, when the bag is filled with liquid and sealed, once the closure has been opened or removed and the neck portion has been everted into the dispensing position, progressively stronger squeezing of the body portion of the bag will cause the hermetically sealed mouth to burst open before any other portion of the bag bursts open.

Clause 7. The disposable container of clause 1 wherein the closure hermetically seals the inside-out stored neck portion at the continuous fold.

Clause 8. The disposable container of clause 1 wherein the body portion has a substantially rectangular shape and wherein the neck portion is tapered.

Clause 9. The disposable container of clause 1 wherein the body portion of the bag has a substantially rectangular shape and the neck portion of the bag has a substantially trapezoidal shape.

Clause 10. The disposable container of clause 1 wherein the closure comprises a clip with a depressible release mechanism for opening the clip to permit the eversion of the neck portion into the dispensing position.

Clause 11. The disposable container of clause 10 wherein the clip is elongate and has a pair of arms, a hinge at one end of the arms, and the depressible release mechanism at the other end of the arms, the depressible release mechanism for keeping distal ends of the pair of arms in fixed relation to one another so as to hold the continuous fold therebetween until the clip is opened.

Clause 12. The disposable container of clause 11 wherein the depressible release mechanism comprises a breakaway piece that bridges the distal ends of the arms.

Clause 13. The disposable container of clause 12 wherein the closure further comprises a breakable element between the breakaway piece and the distal end of one of the arms, the breakaway piece having a lever element, the lever element configured to, upon application of a pushing force to a distal end of the lever element, convert the pushing force to a tensile force for breaking the breakable element.

Clause 14. The disposable container of clause 11 further comprising an adhesive material adhering a portion of an inner face of each of the pair of arms to the bag at or near the continuous fold, wherein the portion of the inner face is proximal to the hinge.

Clause 15. A method of manufacturing a container for sanitary dispensing of a consumable liquid, the method comprising: forming a bag from at least one sheet of flexible, liquid-impermeable material, the bag having a body portion and a neck portion in fluid communication with the body portion, the neck portion having a hermetically sealed mouth, the body portion having an opening for filling the bag with the consumable liquid; tucking the neck portion into the body portion of the bag, the tucking causing the neck portion to turn inside-out and resulting in a continuous fold in the bag; and applying a closure to hold together opposite sides of the bag at the continuous fold so that the neck portion remains tucked, in an inside-out state, within the body portion upon subsequent filling of the bag with the consumable liquid using the opening, the closure also to shield the neck portion from external contaminants pending removal of the closure and eversion of the neck portion into a dispensing position.

Clause 16. The method of clause 15 further wherein the applying of the closure comprises hermetically sealing the neck portion at the continuous fold.

Clause 17. The method of clause 15 further comprising inflating the bag to facilitate the tucking of the neck portion of the bag into the body portion of the bag.

Clause 18. The method of clause 17 wherein the tucking comprises extending a mandrel towards the inflated bag to push the inflated neck portion into the inflated body portion of the bag and to simultaneously turn the neck portion inside-out.

Clause 19. The method of clause 18 wherein the tucking further comprises ceasing the inflating and then removing the mandrel to leave the neck portion inside the body portion in an inside-out state.

Clause 20. The method of clause 19 wherein the tucking further comprises holding the opening closed during the removing of the mandrel.

Clause 21. The method of clause 15 further comprising filling the bag with liquid before the tucking.

Clause 22. The method of clause 21 wherein the tucking comprises extending a mandrel towards the liquid-filled bag to push the neck portion into the liquid-filled body portion and to simultaneously turn the neck portion inside-out.

Other modifications may be made within the scope of the following claims.

What is claimed is:

1. A disposable container for hygienic dispensing of a consumable liquid by squeezing, comprising:

a bag made from a flexible, liquid-impermeable material, the bag having a flexible body portion for containing a consumable liquid and a flexible neck portion with a hermetically sealed mouth at a distal end of the neck portion, the mouth for dispensing the consumable liquid when opened, the neck portion being in a stored position tucked inside-out inside the body portion, the tucking resulting in a continuous fold in the bag; and a closure for holding together opposite sides of the bag at the continuous fold to maintain the neck portion of the bag in the stored position, tucked inside-out within the body portion, and to shield the neck portion from external contaminants pending opening of the closure and eversion of the neck portion into a dispensing position, wherein the hermetically sealed mouth is configured as the weakest point of the bag so that, when the bag is filled with the consumable liquid and sealed, once the closure has been opened and the neck portion has been everted into the dispensing position by squeezing of the body portion, progressively stronger squeezing of the body portion of the bag will burst open the hermetically sealed mouth for dispensing of the consumable liquid before any other portion of the bag bursts open, wherein the closure is configured to prevent the eversion of the neck portion in the event that the body portion is squeezed before the closure has been opened, wherein the closure comprises a pliable cover straddling the continuous fold and affixed to the bag on opposite sides of the continuous fold, the pliable cover including a tear strip configured to, upon being torn, facilitate the opening of the closure by separating the closure into two halves, and wherein an end of the tear strip is anchored to either or both of the closure halves.

2. The disposable container of claim 1 wherein the pliable cover including the tear strip comprises adhesive tape affixed to the opposite sides of the bag at or near the continuous fold.

3. The disposable container of claim 1 further comprising a barrier supplementary to the closure, the supplementary barrier providing a hermetic seal between opposite walls of the bag at or near the continuous fold.

4. The disposable container of claim 1 wherein the closure hermetically seals the inside-out stored neck portion at the continuous fold.

5. The disposable container of claim 1 wherein the body portion has a substantially rectangular shape and wherein the neck portion is tapered.

6. The disposable container of claim 1 wherein the pliable cover is affixed to the bag by an adhesive on either side of the continuous fold and wherein the pliable cover is free of adhesive on an underside of the tear strip.

7. The disposable container of claim 1 wherein the pliable cover including the tear strip comprises silicone or wax affixed to the opposite sides of the bag at or near the continuous fold.

8. The disposable container of claim 1 further comprising a wing extending from the body portion, the wing having a longitudinal twist or bend configured to cause the disposable container to spin when the disposable container has been filled with the consumable liquid and is dropped from an airborne platform.

9. The disposable container of claim 8 wherein the wing has a hole therethrough to facilitate carrying of the disposable container.

10. The disposable container of claim 8 wherein the wing is integrally formed with the body portion.

11. The disposable container of claim 8 wherein the wing is attached to the body portion.

12. A disposable container for hygienic dispensing of a consumable liquid by squeezing, comprising:

a bag made from a flexible, liquid-impermeable material, the bag having a flexible body portion for containing a consumable liquid and a flexible neck portion with a hermetically sealed mouth at a distal end of the neck portion, the mouth for dispensing the consumable liquid when opened, the neck portion being in a stored position tucked inside-out inside the body portion, the tucking resulting in a continuous fold in the bag; and closure means for holding together opposite sides of the bag at the continuous fold to maintain the neck portion of the bag in the stored position, tucked inside-out within the body portion, and for shielding the neck portion from external contaminants pending opening of the closure means and eversion of the neck portion into a dispensing position, wherein the hermetically sealed mouth is configured as the weakest point of the bag so that, when the bag is filled with the consumable liquid and sealed, once the closure means have been opened and the neck portion has been everted into the dispensing position by squeezing of the body portion, progressively stronger squeezing of the body portion of the bag will burst open the hermetically sealed mouth for dispensing of the consumable liquid before any other portion of the bag bursts open, wherein the closure means are configured to prevent the eversion of the neck portion in the event that the body portion is squeezed before the closure means has been opened, wherein the closure means comprise pliable cover means straddling the continuous fold and affixed to the bag on opposite sides of the continuous fold, the pliable cover means having tear strip means configured to, upon being torn, facilitate the opening of the closure means by separating the closure means into two halves, and wherein an end of the tear strip means is anchored to either or both of the halves of the closure means.

13. The disposable container of claim 12 wherein the pliable cover means having the tear strip means comprise adhesive tape affixed to the opposite sides of the bag at or near the continuous fold.

14. The disposable container of claim 12 wherein the pliable cover means having the tear strip means comprise silicon or wax affixed to the opposite sides of the bag at or near the continuous fold.

15. The disposable container of claim 12 further comprising a wing extending from the body portion, the wing having a longitudinal twist or bend configured to cause the disposable container to spin when the disposable container has been filled with the consumable liquid and is dropped from an airborne platform.

16. The disposable container of claim 15 wherein the wing has a hole therethrough to facilitate carrying of the disposable container.

17. The disposable container of claim 15 wherein the wing is integrally formed with the body portion.

18. The disposable container of claim 15 wherein the wing is attached to the body portion.

19. A disposable container for hygienic dispensing of a consumable liquid by squeezing, comprising:

a bag made from a flexible, liquid-impermeable material, the bag having a flexible body portion for containing a consumable liquid and a flexible neck portion with a hermetically sealed mouth at a distal end of the neck portion, the mouth for dispensing the consumable liquid when opened, the neck portion being in a stored position tucked inside-out inside the body portion, the tucking resulting in a continuous fold in the bag; and a closure for holding together opposite sides of the bag at the continuous fold to maintain the neck portion of the bag in the stored position, tucked inside-out within the body portion, and to shield the neck portion from external contaminants pending opening or removal of the closure and eversion of the neck portion into a dispensing position, wherein the hermetically sealed mouth is configured as the weakest point of the bag so that, when the bag is filled with the consumable liquid and sealed, once the closure has been opened or removed and the neck portion has been everted into the dispensing position by squeezing of the body portion, progressively stronger squeezing of the body portion of the bag will burst open the hermetically sealed mouth for dispensing of the consumable liquid before any other portion of the bag bursts open, wherein the closure comprises a clip with a release mechanism for opening the clip to permit the eversion of the neck portion into the dispensing position, wherein the clip is elongate and has a pair of arms, a hinge at one end of the arms, and the release mechanism at the other end of the arms, the release mechanism for keeping distal ends of the pair of arms in fixed relation to one another so as to hold the continuous fold therebetween until the clip is opened, and wherein the release mechanism comprises a breakaway piece that bridges the distal ends of the arms and a breakable element between the breakaway piece and the distal end of one of the arms, the breakaway piece having a lever element, the lever element configured to, upon application of a pushing force to a distal end of the lever element, convert the pushing force to a tensile force for breaking the breakable element.

20. The disposable container of claim 19 further comprising an adhesive material adhering a portion of an inner face of each of the pair of arms to the bag at or near the continuous fold, wherein the portion of the inner face is proximal to the hinge.

* * * * *